US008913087B1

(12) United States Patent
Kejriwal

(10) Patent No.: US 8,913,087 B1
(45) Date of Patent: Dec. 16, 2014

(54) DIGITAL IMAGE CROPPING

(75) Inventor: Parmanand P. Kejriwal, Saratoga, CA (US)

(73) Assignee: Amazon Technologies, Inc., Reno, NV (US)

( * ) Notice: Subject to any disclaimer, the term of this patent is extended or adjusted under 35 U.S.C. 154(b) by 1301 days.

(21) Appl. No.: 12/507,370

(22) Filed: Jul. 22, 2009

(51) Int. Cl.
*G09G 5/00* (2006.01)

(52) U.S. Cl.
USPC ..... 345/660; 345/173

(58) Field of Classification Search
USPC ..... 345/173, 660; 715/243, 205, 209, 273; 358/1.18, 453; 382/159
See application file for complete search history.

(56) References Cited

U.S. PATENT DOCUMENTS

| | | | | |
|---|---|---|---|---|
| 5,212,568 | A * | 5/1993 | Graves et al. | 358/453 |
| 6,256,650 | B1 * | 7/2001 | Cedar et al. | 715/273 |
| 7,908,284 | B1 * | 3/2011 | Mathes et al. | 715/205 |
| 7,912,829 | B1 * | 3/2011 | Mathes et al. | 715/205 |
| 7,979,785 | B1 * | 7/2011 | Wang et al. | 715/205 |
| 2006/0066905 | A1 * | 3/2006 | Takashima et al. | 358/1.18 |
| 2006/0164441 | A1 * | 7/2006 | Wada et al. | 345/649 |
| 2009/0109185 | A1 * | 4/2009 | Barclay et al. | 345/173 |
| 2009/0109468 | A1 * | 4/2009 | Barclay et al. | 358/1.15 |
| 2009/0109498 | A1 * | 4/2009 | Barclay et al. | 358/474 |
| 2009/0113291 | A1 * | 4/2009 | Barclay et al. | 715/243 |
| 2009/0222714 | A1 * | 9/2009 | Vaschillo et al. | 715/200 |
| 2009/0278958 | A1 * | 11/2009 | Bregman-Amitai et al. | 348/231.99 |
| 2011/0102467 | A1 * | 5/2011 | Kudo et al. | 345/660 |
| 2012/0178414 | A1 * | 7/2012 | Fiatal | 455/406 |
| 2013/0039572 | A1 * | 2/2013 | Coulombe et al. | 382/159 |

OTHER PUBLICATIONS

U.S. Appl. No. 11/392,999, filed Mar. 28, 2006, Goodwin, et al., "Processing Digital Images Including Headers and Footers Into Reflow Content".

* cited by examiner

*Primary Examiner* — Chante Harrison
(74) *Attorney, Agent, or Firm* — Lee & Hayes, PLLC

(57) ABSTRACT

A digital image to be presented on an electronic display of an electronic device is expanded so that the content of the digital image fits the electronic display and the margins are cropped (e.g., rendered invisible) on the electronic display. The initial determination may be for a first total length of a left margin and a right margin of the digital image. The second determination may be for a second total length of a top and a bottom margin of the digital image. An expansion factor based at least in part on the smaller of the first and second total lengths may be derived. The application of the expansion factor enables the creation of an expanded digital image having content that maximally fit the electronic display. In some aspects, the expanded digital image is stored in a data cache.

32 Claims, 11 Drawing Sheets

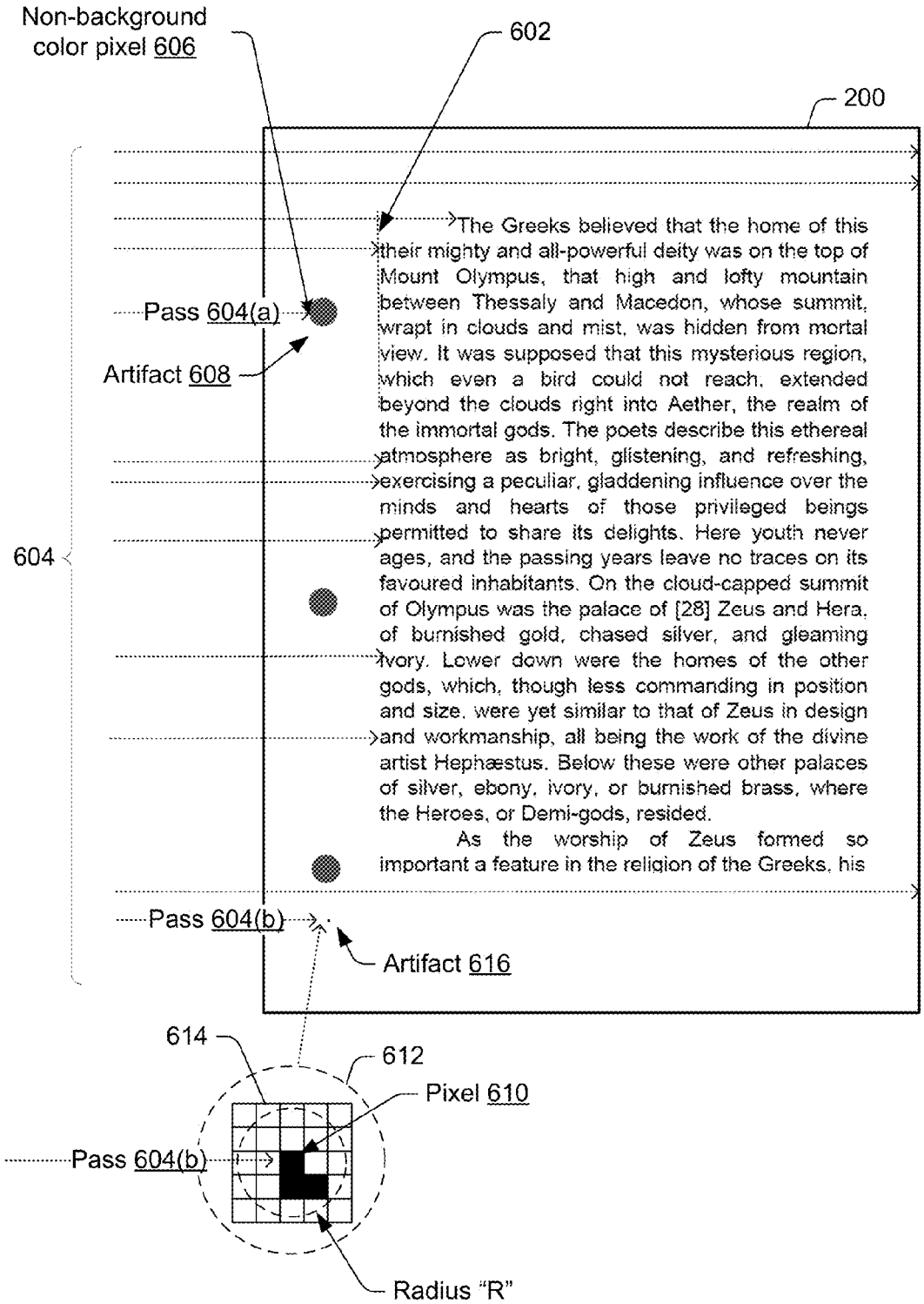

The Greeks believed that the home of this their mighty and all-powerful deity was on the top of Mount Olympus, that high and lofty mountain between Thessaly and Macedon, whose summit, wrapt in clouds and mist, was hidden from mortal view. It was supposed that this mysterious region, which even a bird could not reach, extended beyond the clouds right into Aether, the realm of the immortal gods. The poets describe this ethereal atmosphere as bright, glistening, and refreshing, exercising a peculiar, gladdening influence over the minds and hearts of those privileged beings permitted to share its delights. Here youth never ages, and the passing years leave no traces on its favoured inhabitants. On the cloud-capped summit of Olympus was the palace of [28] Zeus and Hera, of burnished gold, chased silver, and gleaming ivory. Lower down were the homes of the other gods, which, though less commanding in position and size, were yet similar to that of Zeus in design and workmanship, all being the work of the divine artist Hephæstus. Below these were other palaces of silver, ebony, ivory, or burnished brass, where the Heroes, or Demi-gods, resided.

As the worship of Zeus formed so important a feature in the religion of the Greeks, his

FIG. 6

DIGITAL IMAGE CROPPING

BACKGROUND

As more and more users turn to computer networks such as the Internet and particularly the World Wide Web (hereinafter the "Web") for information, content providers are increasingly converting traditional content (e.g., printed materials such as books, magazines, newspapers, newsletters, manuals, guides, references, articles, reports, documents, and the like) to electronic form.

For some content providers, a quick and simple way to convert printed content to an electronic form for publication is to create a digital image of the printed content, i.e., a digital image containing representation of text or images from the traditional content. As those skilled in the art will appreciate, this type of conversion is typically performed through the use of a scanner. However, while simply generating a digital image (or images) of printed content can be accomplished quickly, the resulting digital images might not be particularly well suited for various scenarios. For example, digital images corresponding to the conversion of pages of a book into electronic form may not be well suited in some viewing scenarios. Of course, the reasons that a digital image is not always an optimal form/format of delivery are many, but include issues regarding the clarity or resolution of digital images, the large size of a digital image file and, perhaps most importantly, the rendering of the digital images on various sized displays. For example, traditional digital images may be of a fixed size and include substantial margins or white space around the text or images.

The margins may take up a significant portion of an electronic display when the digital image is presented on a computing device. Thus, the margins may detract from the presentation of the digital image as the margins may effectively reduce the amount of "active" display area of the electronic display, in essence making the display area smaller than its actual size.

BRIEF DESCRIPTION OF THE DRAWINGS

The detailed description is described with reference to the accompanying figures. In the figures, the left-most digit(s) of a reference number identifies the figure in which the reference number first appears. The same reference numbers in different figures indicate similar or identical items.

FIG. 6 shows illustrative elimination of artifacts from a digital image during the processing of the digital image, in accordance with one or more embodiments.

DETAILED DESCRIPTION

Overview

Figure 1:
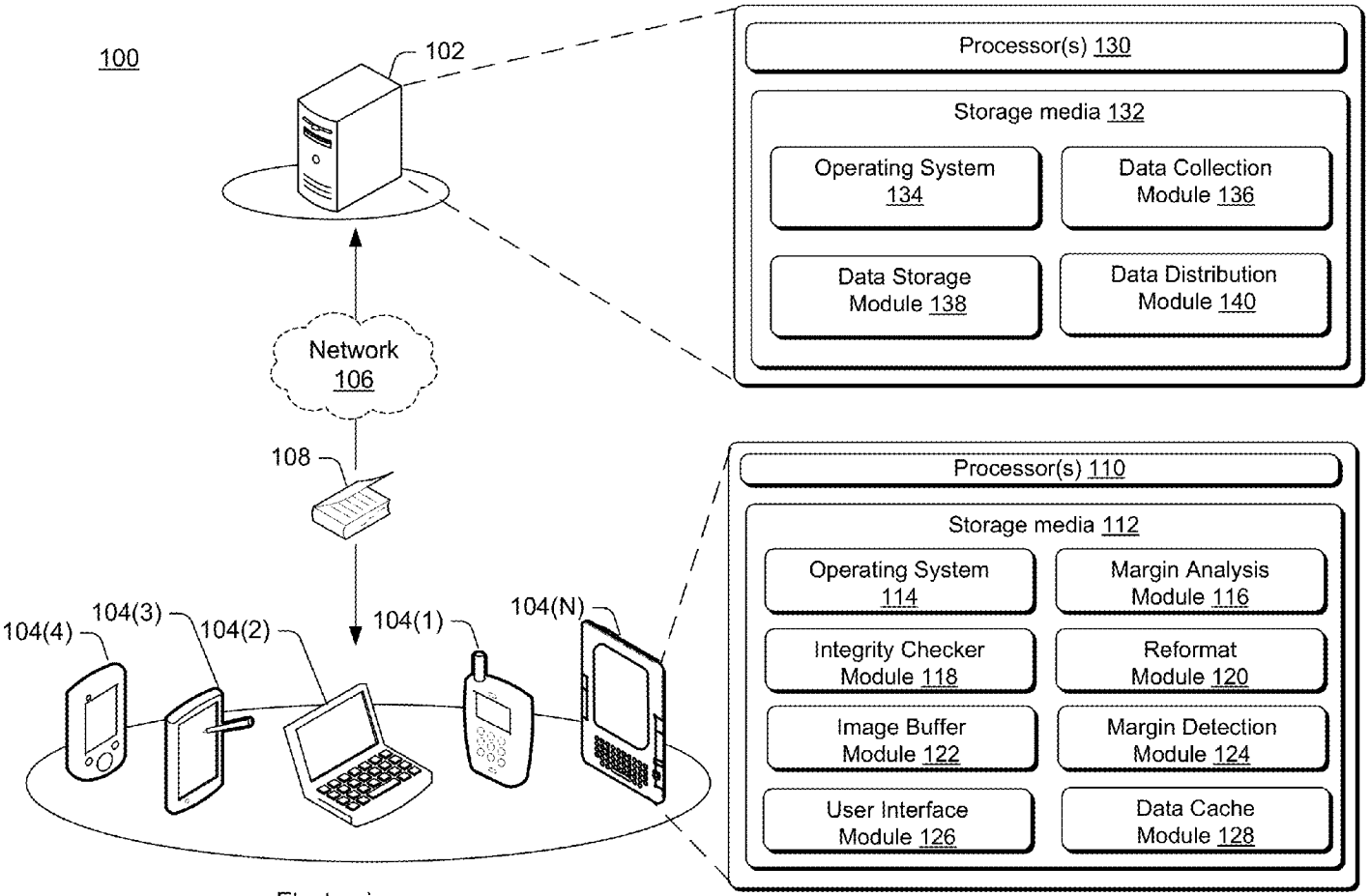
FIG. 1 shows an illustrative computing environment in which one or more embodiments of digital image cropping may be implemented, in accordance with one or more embodiments.

The disclosure is directed to minimizing the display of margins, or white space included in a digital image. In various embodiments, the digital image may be, but is not limited to, a page from a book, magazine, an advertisement, a newspaper, a newsletter, a manual, a guide, a reference, an article, a report, and/or any other work for visually transmitting information. A collection of digital images (digital image collection) as referred to herein may be, but is not limited to, a series of digital images corresponding to pages of a book, a magazine, an advertisement, a newspaper, a newsletter, a manual, a guide, a reference, an article, a report and/or any other work that may be represented as one or more digital images.

A digital image may include reproduction of content, as well as reproduction of margins that surround the content. Content of a digital image may include one or more of letters, characters, symbols, numbers, formulas, graphics, line drawings, table borders, images, textual content, and the like, that are used to visibly present information. Margins refer to the area that surrounds the content of a digital image.

In one or more embodiments, a digital image may be created via the optical scanning and digitalization of a corresponding page of traditional content. For instance, an optical character recognition (OCR) device or other suitable techniques may be used to identify and convert recognizable text in the traditional content into a document image or selectable text (e.g., ASCII text).

As described herein, each digital image may be optimized for viewing on the electronic display. The electronic display may refer to any display technology that electronically renders an image, such as a cathode ray tube (CRT) display, a liquid crystal display (LCD), a plasma display, a light emitting diode (LED) display, or an electronic paper display. The digital image cropping techniques disclosed herein may crop the margins, or white space, when each digital image is displayed on an electronic display. As stated above, the margins may reduce the amount of active display area of the electronic display, in essence making the display area smaller than its actual size. Thus, the cropping of the margins may maximize or enlarge the display of the actual content in each digital image to facilitate the viewing of the actual content on the electronic display.

In various embodiments, the cropping of the margins of a digital image may be achieved via the expansion of the digital image. The expanded digital image may then be presented on the electronic display in such a way that the margins are outside of the display area of the electronic display, so that the digital image is effectively "cropped." In this implementation of cropping, the degree of expansion may be determined based on the smaller margin length, of the total top and bottom margins, or the left and right margins, on the digital image. The use of the smaller margin length may ensure maximized cropping of the margins of the digital image without the inadvertent cropping of the actual content.

For purposes of discussion, the cropping of the margins of a digital image may be described with respect to the manipulation of the digital image, the content contained in and represented by the digital image, or both. However, it is understood that the actual manipulation may be performed in memory with respect to the underlying data file that drives the presentation of the digital image. An illustrative environment and techniques for performing digital image cropping is provided below. However, the described digital image cropping techniques may be implemented in other environments.

Illustrative System Architecture

FIG. 1 shows an illustrative computing environment 100 in which one or more embodiments of digital image cropping may be implemented, in accordance with one or more embodiments. The environment 100 includes a server 102 and a plurality of electronic devices 104 that are communicatively connected by a network 106.

The network 106 may be a local area network ("LAN"), a larger network such as a wide area network ("WAN"), or a collection of networks, such as the Internet. Protocols for network communication, such as TCP/IP, may be used to implement the network 106. Although embodiments are described herein as using a network such as the Internet, other distribution techniques may be implemented that transmit information via memory cards, flash memory, or other portable memory devices. The electronic devices 104 may include a mobile phone 104(1), a portable computer 104(2), a tablet computer 104(3), a personal digital assistant (PDA) 104(3), an e-book reader 104(N), and/or other electronic devices that are equipped with network communication components, data processing components, and electronic displays for displaying data.

In one or more embodiments, each of the electronic devices 104 may receive one or more digital images from the server 102 via the network 106 and display the one or more of the digital images on an electronic display. In some instances, the one or more digital images may be received on each of the electronic devices 104 from the server 102 as a part of at least one digital image collection 108. The electronic display may be a liquid crystal display (LCD), organic light emitting diode (OLED) display, a plasma display, an electronic paper display, or any other form of electronic display that is capable presenting data in color, monochrome, and/or grayscale.

The one or more digital images may be presented on an electronic display of an electronic device 104, such as the e-book reader 104(N), via a software application (e.g., a document viewer application) that converts the one or more digital images from a storage format into graphical display data suitable for display on the electronic display. In accordance with various embodiments, the one or more digital images may correspond to one or more traditional pages of text, fonts, images, and/ vector graphics. In accordance with one or more embodiments, the one or more digital images may be in the form of a Portable Document Format (PDF) file, a word processing document file, an image file, and the like.

Each of the electronic devices 104 may further include user controls that enable a user to request the one or more digital images or the one or more digital image collections 108 from the server 102. User controls may include, but are not limited to, combinations of one or more of keypads, keyboards, mouse devices, touch screens, microphones, speech recognition packages, and any other suitable devices or other electronic/software selection methods. Moreover, as further described below, each of the electronic devices 104 may also include a memory cache for storing the one or more digital images and/or the one or more digital image collections 108.

As shown in FIG. 1, each of the electronic devices 104, such as the e-book reader 104(N), may include one or more processors 110 and a storage media 112. The storage media 114 may store an operating system 114, as well as other modules. The modules may include routines, programs, objects, components, and data structures that cause the e-book reader 104(N) to perform particular tasks. The modules may include a margin analysis module 116, a reformat module 120, a image buffer module 122, a content detection module 122, a user interface module 126, and a data cache module 128.

The operating system 114 may include components that enable the e-book reader 104(N) to receive data via various inputs (e.g., user controls, network interfaces, and/or memory devices), process data using the one or more processors 110 to generate output. The operating system 114 may include a display component that presents the output (e.g., display the digital image on an electronic display, store data in memory, transmit data to another electronic device, etc.). Additionally, the operating system 114 may include other components that perform various other functions generally associated with an operating system.

The margin analysis module 116 may determine margins that may be cropped to maximize the display of the content in a digital image collection 108. The margin analysis module 116 may perform the determination when a user triggers the display of a digital image via user controls and the user interface module 126. To facilitate the cropping of the margins, the margin analysis module 116 may calculate an expansion factor to apply to the digital image. By expanding the digital image by this expansion factor, the margins may be logically pushed off of the display when the digital image is rendered and, effectively, cropped. The illustrated determination of the margins that may be cropped and the calculation of an expansion factor by the margin analysis module 116 may be further described in FIG. 2.

Figure 2:
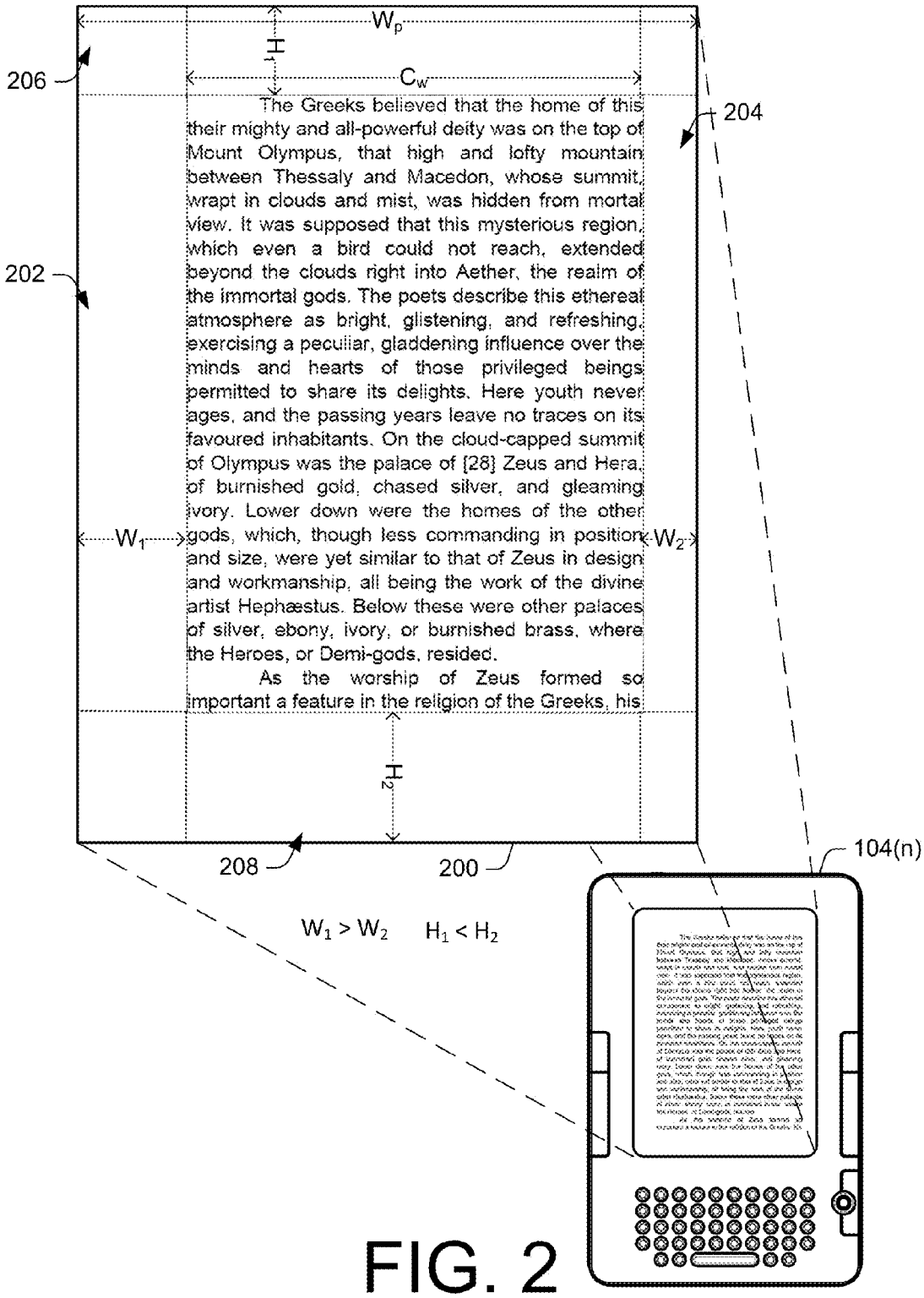
FIG. 2 shows illustrative calculations for obtaining an expansion factor that facilitates the cropping of the margins from a digital image, in accordance with one or more embodiments.

FIG. 2 shows illustrative calculations for obtaining an expansion factor that facilitates the cropping of the margins from a digital image 200, in accordance with one or more embodiments. The digital image 200 may be suitable for display on an electronic device 104, such as the e-book reader 104(N). Again, while FIG. 2 illustrates the cropping while the e-book reader 104(N) renders the digital image, the cropping may actually occur before the e-book reader 104(N) actually renders the digital image. As described below, the cropping may occur at the e-book reader 104(N), at the server 102 or even at another electronic device 104.

As shown, the margin analysis module 116 may obtain a first length, $W_1$, of a left margin 202 in a digital image 200, and a second length, $W_2$, of the right margin 204 in the digital image 200. Likewise, the margin analysis module 116 may further obtain a third length, $H_1$, of a top margin 206 in the digital image 200, and a fourth length, $H_2$, of the bottom margin 208 in the digital image 200. In some instances, the margins 202, 204, 206 and 208 may overlap at the corners of the digital image 200. Furthermore, in at least some embodiments, the lengths $W_1$, $W_2$, $H_1$, and $H_2$, as well as other dimensions present on the digital image 200, may be measured in term of pixels.

Once the margin analysis module 116 has obtained the lengths $W_1$, $W_2$, $H_1$, and $H_2$, the margin analysis module 116 may derive an expansion factor. In accordance with various embodiments, the margin module 122 may first perform the following calculations to obtain a first total length, $W_t$, of the left and right margins, and a second total length, $H_t$, of the top and bottom margins:

$$W_t = W_1 + W_2 \quad (1)$$

$$H_t = H_1 + H_2 \quad (2)$$

Subsequently, the margin analysis module 116 may derive a width of the content, $C_w$, as a difference between a known total width of the digital image, $W_p$, and the first total length $W_t$ as follows:

$$C_w = W_p - W_t \quad (3)$$

Next, the margin analysis module 116 may derive the expansion factor, $Z_f$, using the following equation:

$$Z_f = \frac{C_w + \min(W_t, H_t)}{C_w} \quad (4)$$

In which the min ($W_t$, $H_t$) function provides the smaller of the first total length $W_t$ and the second total length, $H_t$. The expansion factor, $Z_f$, may be further implemented by a reformat module 120 (shown in FIG. 1) to maximize or otherwise enlarge the display of content in the digital image 200 in the electronic display of the e-book reader 104(N).

In some embodiments, the margin analysis module 116 may use an integrity checker module 118 (also shown in FIG. 1) to determine whether the expansion factor exceeds a predetermined expansion threshold. An expansion factor that exceeds the predetermined threshold, when applied to a digital image, such as the digital image 200, may result in significant degradation of the digital image. For example, an expansion factor that exceeds the predetermined threshold may result in pixilation or blurring of graphics and/or text in the digital image 200. In another example, since data file size of a digital image may increase as the size of the digital image increases, the application of an expansion factor that exceeds a predetermined threshold may result unmanageably large data files that may degrade the performance of an electronic device 104, such as the e-book reader 104(N).

In at least one embodiment, the predetermined expansion threshold may be set to "3.0". In these instances, the techniques will refrain from expanding a digital image by any expansion factor that is greater than 3.0. As such, if the margin analysis module determines that an expansion factor of 3.5 would maximize the display of the content, the integrity checker module 118 may lower the actual used expansion factor to 3.0. However, the predetermined expansion threshold may be set to any number in other embodiments, depending on the needs of the user, performance specifications of the electronic devices 104 and any other applicable factors.

Returning to FIG. 1, in some embodiments, the margin analysis module 116 may derive a universal expansion factor that may be implemented by a reformat module 120 to maximize the display of contents in a plurality of digital image. In such embodiments, the margin analysis module 116 may obtain an expansion factor for each of a predetermined number of digital images of a collection of digital images. For example, the margin analysis module 116 may calculate an expansion factor for five digital images from a collection of digital images. This predetermined number of digital images may correspond to a particular segment or chapter of content from the collection of digital images, may be specified by the user, may be a specified value, etc. It will be appreciated that the predetermined number may be any integer.

Subsequently, the margin analysis module 116 may determine the most common expansion factor in the set of obtained expansion factors. For example, but not as a limitation, if the set of expansion factors is the following: {1.2, 1.2, 1.2 1.8, 1.1}, the margin analysis module 116 may determine that the expansion factor "1.2" is the most common (or "median") expansion factor. The margin analysis module 116 may then designate the most common expansion factor as the universal expansion factor to be applied to every digital image in the collection of digital images. In various embodiments, the predetermined number of digital images may be sampled consecutively from anywhere in the collection of digital images (e.g., beginning of document, middle of document, end of document). In other embodiments, the margin analysis module 116 may sample the predetermined number of digital images randomly from the collection of digital images. The application of a universal expansion factor to the entire collection of digital images may reduce the processing power and/or memory needs of the margin analysis module 116.

In further embodiments, meanwhile, the margin analysis module 116 may use the average as opposed to the median as the universal expansion factor. In the above example, for instance, the margin analysis module 116 may use the average expansion factor of "1.3" as the universal expansion factor. In addition, in some instances the margin analysis module 116 may apply the universal expansion factor to only a portion of the collection of digital images rather than the entire collection of digital images. In additional embodiments, the margin analysis module 116 may use the smallest expansion factor of "1.1" as the universal expansion factor so that no digital images in the collection of digital images loses content during display due to over expansion. In these above embodiments, the margin analysis module 116 may re-calculate a universal expansion factor for different portions of the collection of digital images at periodic or even random intervals.

In various embodiments, the margin analysis module 116 may store the expansion factors for the one or more digital images as metadata that is associated with each digital image. The metadata may be stored in a data cache module 128 for subsequent retrieval by the reformat module 120. In further embodiments, and as further described below, the margin analysis module 116 may use the image buffer module 122 to detect whether an expanded version of the digital image 200, or a pre-calculated expansion factor for the digital image 200, is available prior to determining the expansion factor for the digital image 200. In at least one embodiment, the image buffer module 122 may determine whether the expanded version of the digital image 200 or the corresponding pre-calculated expansion factor is available in the data cache module 128 or the server 102.

In accordance with some embodiments, the reformat module 120 may use the expansion factor that is derived for a particular digital image to maximize the display of the content of the digital image (e.g., digital image 200). In other embodiments, the reformat module 120 may also use a universal expansion factor to maximize the display of the content of a plurality of digital images of a document. The reformat module 120 may retrieve the expansion factor metadata for each digital image from the data cache module 128. The illustrative operation of the reformat module 120 is further described in FIG. 3.

Figure 3:
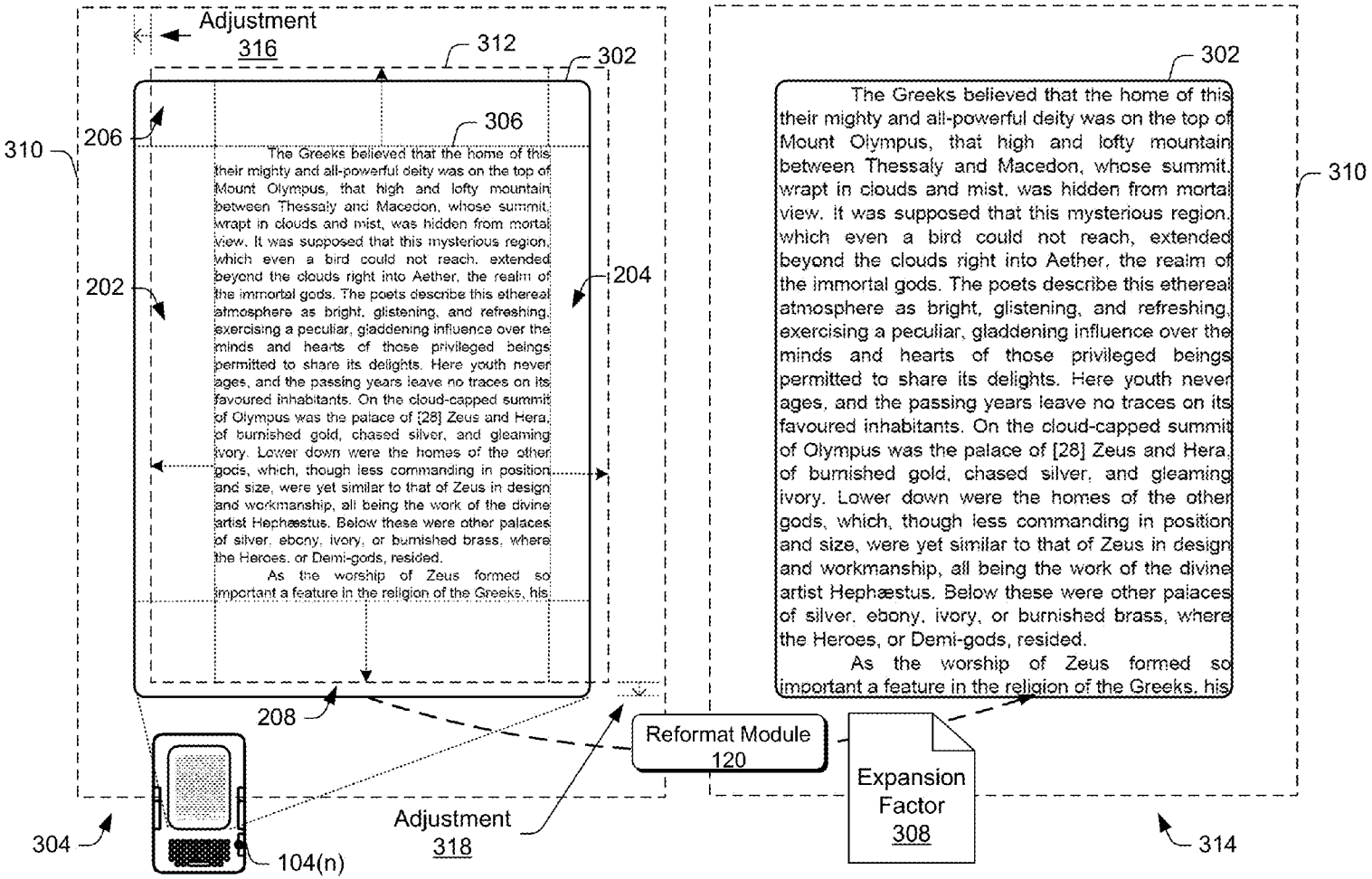
FIG. 3 shows an illustrative "cropping" of the margins of a digital image via the fitting of the content of the digital image to an electronic display, in accordance with one or more embodiments.

FIG. 3 shows an illustrative cropping of the margins that surround a digital image via the fitting of the content of the digital image to an electronic display, in accordance with one or more embodiments. For the purpose of comparison, the digital image 200 described in FIG. 2 is shown in a display 302 of an electronic device (e.g., e-book reader 104(N)) in an unaltered state 304, (i.e., prior to being expanded to maximize the display of content). Thus, as shown, the digital image 200 may be presented in the electronic display 302 with the margins 204-208 intact, so that a content portion 306 of the digital image 200 is surrounded by the margins 204-208, as previously described in FIG. 2. Again, however, in some instances the cropping occurs before the rendering of the digital image and, as such, the display 302 refrains from rendering the digital image in its unaltered state 304.

The reformat module 120 may apply an expansion factor 308 to the digital image 200 to generate a corresponding expanded digital image. The expansion factor 308 may be specifically derived for the digital image 200 as described in FIG. 2. The application of the derived expansion factor 308 may proportionally expand the size of the digital image 200 to the size 310. Likewise, the content portion 306 may be expanded into a new size 312. As illustrated in the altered state 314, since the derived expansion factor 308, is calculated based on the relationship between the content and the margins (e.g., left and right margins 202-204) of the digital image 200, the new size 310 of the content portion 306 may enable the content portion 306 to be maximally displayed in the electronic display 302. In other words, the reformat module 120 may expand the digital image 200 based on the expansion factor 308 so that the margins 202-208 of the digital image 200, are outside of the electronic display 302 (i.e., cropped) when the content portion 306 is fully presented in the electronic display 302.

However, in additional embodiments, the reformat module 120 may modify the expansion factor 308 to obtain a modified expansion factor that is a certain percentage less than the expansion factor 308. For example, in at least embodiments, the modified expansion factor may be a ten percent less than the expansion factor 308. Accordingly, the reformat module 120 may expand the digital image 200 based on the modified expansion factor. In such embodiments, while at least a portion of each of the margins 202-208 of the digital image 200 may be outside of the electronic display 302 (i.e., cropped) when the content 306 is presented on the electronic display 302, a remaining portion of each of the margins 202-208 may remain present. In other words, the size of each of the margins 202-208 may be reduced from an original size to a smaller size.

In some embodiments, rather than simply expanding the digital image 200 using the expansion factor 308, the reformat module 120 may further modify the data that corresponds to the expanded digital image 200 by omitting a portion of the data that enables the display of the margins 202-208. In other words, the reformate module 120 may permanently delete the margins 202-208 from the data that of the expanded digital image 200. Therefore, when an electronic device 104 later renders the expanded digital image 200, the device may display the expanded digital image 200 without the calculating or even applying the expansion factor 308 to the original digital image.

In accordance with various embodiments, the reformat module 120 may further adjust the position of the expanded digital image 200 so that the expanded digital image 200 may be properly displayed. For example, returning to FIG. 2, the length $W_1$ (length of margin 202) of the digital image 200 may be longer than length $W_2$ (length of margin 204) of the digital image.

Thus, when the digital image 200 is proportionally expanded based on the corresponding expansion factor 308, such proportional expansion of the digital image 200 that is in the state 304 may cause a proportional "shift" of the content portion 306 of the expanded digital image 200. In other words, a portion of the content portion 306 with the new size 312 may move out of the bounds of the electronic display 302 if the expanded digital image 200 is "centered" on the electronic display 302 in the same manner as when the digital image 200 is in the state 304.

Thus, the reformat module 120 may apply a horizontal re-center value, $R_w$, to the expanded digital image 200 to compensate for a difference in length between the length of a left margin, such as $W_1$ in FIG. 2, and the length of a right margin, such as $W_2$ in FIG. 2. In this way, the content portion 306 may be "re-centered" horizontally in the electronic display 302. In some embodiments, referring back to FIG. 2, the horizontal re-center value, $R_w$, that compensates for a difference in length between $W_1$ and $W_2$, may be calculated as follows:

$$R_w = \frac{(W_1 + W_2) \times Z_f}{2} \tag{5}$$

In such embodiments, if the obtained $R_w$ is a positive value, the reformat module 120 may shift the content portion 306 towards the left by $R_w$. However, if the obtained $R_w$ is a negative value, the reformat module 120 may shift the content portion 306 towards the right by $R_w$. Moreover, when the obtained $R_w$ is zero, no horizontal re-centering is needed. It will be appreciated that since $W_1$ and $W_2$ may be measured in pixels, $R_w$ may also be expressed in pixels. Thus, as shown in FIG. 3, in an example where $W_1$ is greater than $W_2$ (shown in FIG. 2), the application of equation (5) may result in an adjustment 316 of the expanded content portion 306 (as well as the entire expand digital image 200) towards the left by $R_w$ pixels.

Likewise, in other embodiments, the reformat module 120 may also apply a vertical re-center value, $R_v$, to the expanded digital image 200 to compensate for a difference in length between the length of a top margin, such as $H_1$ shown in FIG. 2, and the length of a bottom margin, such as $H_2$ shown in FIG. 2. In this way, the content portion 306 may be "re-centered" vertically in the electronic display 302. In some embodiments, referring back to FIG. 2, the vertical re-center value, $R_v$, that compensates for a difference in length between $H_1$ and $H_2$, may be calculated as follows:

$$R_v = \frac{(H_1 + H_2) \times Z_f}{2} \tag{6}$$

In such embodiments, if the obtained $R_v$, is a positive value, the reformat module 120 may shift the content portion 306 towards the top by $R_w$. However, if the obtained $R_w$ is a negative value, the reformat module 120 may shift the content portion 306 towards the bottom by $R_w$. Moreover, when the obtained $R_w$ is zero, no vertical re-centering is needed. Once again, it will be appreciated that since $H_1$ and $H_2$ may be measured in pixels, $R_v$, may also be expressed in pixels. Thus, with respect to FIG. 3, in an example where $H_1$ is greater than $H_2$ (shown in FIG. 2), the application of equation (6) may result in an adjustment 318 of the content portion 306 (as well as the entire expand digital image 200) towards the bottom by $R_v$, pixels. The horizontal and vertical adjustments may ensure that that the expanded content portion 306 is completely visible when displayed in the electronic display 302. It will be appreciated that the $Z_f$ value in equations (5) and (6) may be the expansion factor 308. Alternatively, if the reformat module 120 has applied a modified expansion factor based on the expansion factor 308 to expand the digital image 200, the $Z_f$ value may be the modified expansion factor.

Following the calculation of one or more re-center values for a particular digital image and the expansion of a digital image according to the expansion factor, the reformat module 120 may store the one or more re-center values as metadata that is associated with the particular digital image in the data cache module 128. However, in some embodiments, the reformat module 120 may calculate one or more re-center values for a digital image that is associated with a universal expansion factor. Subsequently, the reformat module 120 may forego any re-center value calculations for any digital image that is associated with the same universal expansion factor. Rather, the reformat module 120 may simply append the re-center values, as calculated for the first digital image associated with the universal expansion factor, as metadata to the one or more of the remainder associated digital images.

Returning to FIG. 1, the image buffer module 122 may store expanded digital images (e.g., expanded digital image 200) produced by the reformat module 120 in the data cache module 128. In various embodiments, the image buffer module 122 may store a predetermined number of the expanded digital images in the data cache module 128. In some embodiments, the expanded digital images may include at least one expanded digital image whose margins are further deleted following expansion. In this way, the stored expanded digital images may be quickly retrieved from the data cache module 128 if the user requests repeated viewings of the expanded digital images. Furthermore, the image buffer module 122 may reduce the need to repeatedly calculate expansion factors and re-center values for the digital images.

In some embodiments, the predetermined number of expanded digital images may be a predetermined number of most recently viewed digital images. In these embodiments, as a more recently viewed digital image is added to the data cache module 128, the image buffer module 122 may remove stored digital images on a first in, first out (FIFO) basis. Accordingly, the storage module 132 may ensure that only the predetermined number of expanded digital images is stored in the data cache module 128. In at least one embodiment, the predetermined number of digital images may be ten digital images. However, it will be appreciated that in other embodiments, the predetermined number may be any value that comports with the memory capacity of the corresponding electronic device, such as the e-book reader 104(N).

In additional embodiments, the image buffer module 122 may further modify an original digital image collection that is stored on the electronic device 104, such as the digital image collection 108, with one or more expanded digital images generated by the reformat module 120. The image buffer module 122 may delete an original digital image from the digital image collection 108, and replace the deleted digital image with a corresponding expanded digital image from the reformat module 120. The image buffer module 122 may perform the deletion after verifying that the digital image to be deleted is an original digital image and not a replacement expanded digital image. For example, but not as a limitation, the image buffer module 122 may perform the verification process by determining whether the digital image is associated with expansion factor and/or re-center metadata.

In some embodiments, when the digital image collection 108 has been replaced in its entirety with expanded digital images, the image buffer module 122 may use the network interface capability of the operating system 114 to upload the digital image collection 108 back to the server 102 for distribution to other electronic devices 104 that possess identical or similar electronic displays.

In alternative embodiments, instead of storing one or more expanded digital images, the image buffer module 122 may instead store the one or more corresponding expansion factors for the expansion of the one or more digital images as metadata in the data cache module 128. In such embodiments, the metadata may include information entries that link each of the expansion factors to one or more corresponding digital images. Each entry may further include information that indicates the size of the electronic display for the implementation of each expansion factor. Accordingly, when a request to display a previously displayed digital image is received, the margin analysis module 116 may retrieve the appropriate expansion factor for application by the reformat module 120, rather than re-calculate the expansion factor for the previously displayed digital image.

In further embodiments, the image buffer module 122 may further use the network interface capability of the operating system 114 to upload individual expanded digital image(s) generated by the reformat module 120, and/or the expansion factor metadata described above, to the server 102. Thus, the server 102 may gather expanded digital images and/or the expansion factor metadata from a plurality of electronic devices having different electronic display sizes. During the upload, the image buffer module 122 may tag the expanded digital image expansion factor with metadata that identifies the particular electronic device 104 that generated the expanded digital image or expansion factor (e.g., manufacturer, model number, version number, device ID, serial number, etc).

Accordingly, the server 102 may sort the uploaded expanded digital images and/or the expansion factors from a plurality of electronic devices 104 and organize them according to types and models of the electronic devices. Thus, since electronic devices of the same type and model generally have identically sized electronic displays, the server 102 may further distribute the uploaded expanded digital images and/or expansion factors to other electronic devices 104 with electronic displays that are suitable for displaying the expanded digital images. In some embodiments, the server 102 may compile the uploaded expanded digital images into complete digital image collections prior to distributing them to the other electronic devices 104. In additional embodiments, the image buffer module 122 may detect whether an expanded version of a digital image, such as the digital image 200, is available prior to determining the expansion factor for the digital image. In other embodiments, the image buffer module 122 may detect whether a pre-calculated expansion factor is available prior to determining the expansion factor for the digital image 200. In at least one embodiment, the image buffer module 122 may perform these detections when commanded by the margin analysis module 116. The margin detection module 124 (shown in FIG. 1) may distinguish the content of a digital image from the margins of the same digital image. For example, but not as limitation, the margin detection module 124 may distinguish the content portion (FIG. 3) of the digital image 200 from the margins 202-208 (FIG. 3) of the digital image 200. Thus, the margin analysis module 116 may employ the content detection during the calculation of expansion factors. The illustrative operation of the margin detection module 124 may be further described in FIG. 4.

Figure 4:
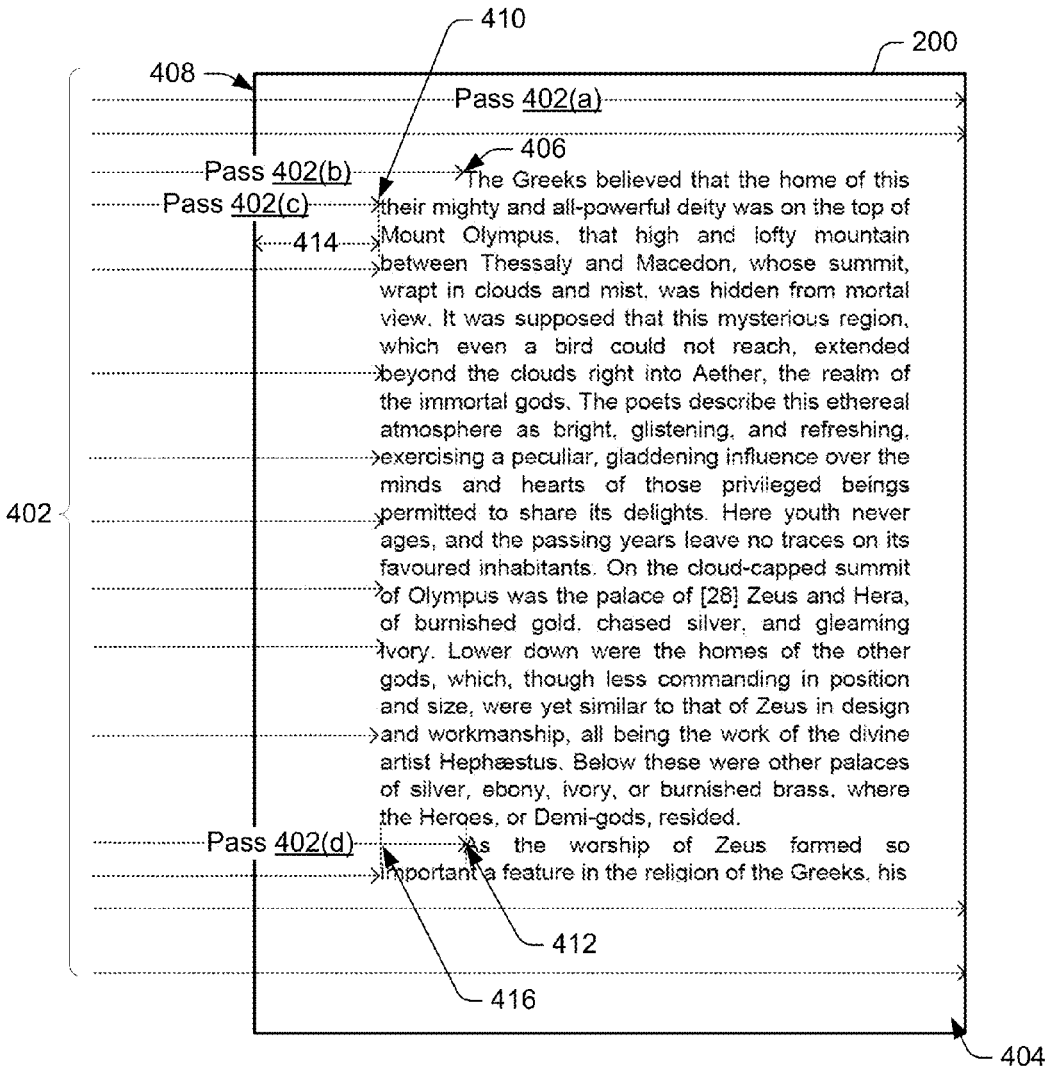
FIG. 4 shows illustrative processing of a digital image to determine a width of the left-side margin that borders the content of the digital image, in accordance with one or more embodiments.

FIG. 4 shows illustrative processing of a digital image by a margin detection module 124 to determine a length of the left-side margin that borders the content of the digital image, in accordance with one or more embodiments. For example, but not as a limitation, the digital image may be the digital image 200 described in FIG. 2. As shown, the margin detection module 124 may attempt to ascertain the edge of the left margin that borders the content. Accordingly, the margin detection module 124 may make repeated processing passes 402 across the digital image from the left side to the right side of the digital image 200, in which the processing passes 402 may start at the top of the digital image 200, and proceed vertically down the digital image 200.

In various embodiments, the margin detection module 124 may make the processing passes 402 for each line of pixels that make up the digital image 200. Thus, the arrows that represent the processing passes 402 are merely illustrative, and are not intended to represent every processing pass made by the margin detection module 124. The margin detection module 124 may determine that content is reached when a pixel has a color value that is different from the color value of the background of the digital image 200. In some embodiments, the color value of background may be the predominate color of the digital image 200 (i.e., a color that is present in the most area of the digital image 200). In other embodiments, the color value of the background may be the color value of one or more corner regions, such as corner region 404, as these regions are most likely to be background rather than containing content.

In the example shown in FIG. 4, the margin detection module 124 may make a processing pass 402(*a*) across the digital image 200 without detecting a color value that is different from the color value of the background of the digital image. Thus, the margin detection module 124 may disregard any horizontal distance value obtained during this processing pass (and other processing passes with similar results) as the horizontal distance covered during the scan is equal to the total width of the digital image 200. Subsequently, the margin detection module 124 may make a processing pass 402(*b*). During the processing pass 402(*b*), the margin detection module 124 may detect a color value change at a position 406 as the processing pass reaches the letter "t" in the word "the". At this point, the margin detection module 124 may make a notation regarding a first horizontal distance between the position 406 and the left edge 408 of the digital image 200. The margin detection module 124 may proceed with further processing passes.

At processing pass 402(*c*), the margin detection module 124 may detect a color value change at a position 410 as the processing pass 402(*c*) reaches the letter "t" in the word "their". Likewise, the margin detection module 124 may make a notation regarding a second horizontal distance between the position 410 and the left edge 408 of the digital image 200. In this manner, the margin detection module 124 may make a plurality of processing passes across the digital image 200, noting the horizontal distance between the edge 408 and any detected content as indicated by a color value change. For example, processing pass 402(*d*) may yield another horizontal distance between position 412 and the edge 408.

Once the margin detection module 124 has made all the processing passes over the digital image 200, the margin detection module 124 may determine the length of the left margin, as represented in FIG. 2 as $W_1$, based on the corresponding plurality of horizontal distances. In various embodiments, the margin detection module 124 may designate the smallest horizontal distance from the plurality of horizontal distances as the length of the left margin. As shown, after performing length comparisons, the margin detection module 124 may designate the distance 414 as the length of the left margin $W_1$.

In some embodiments, the margin detection module 124 may employ additional logics to make the processing passes more efficient. In at least one embodiment described above, the margin detection module 124 may perform a processing pass 402(*c*) that provides a horizontal distance between the position 410 and the left edge 408. However, in this embodiment, the margin detection module 124 may then terminate any subsequent processing passes at position 410 if they do not detector any pixel color value changes prior to a position that is closer to the left edge 308 than the position 410. In a non-limiting example and as shown in FIG. 4, the margin detection module 124 may terminate the processing pass 402(*d*) at position 416, which is the same distance from the left edge 308 as the position 410, rather than at the position 412 as described above. Stated otherwise, since the margin detection module 124 processes the multiple passes to locate a shortest distance between an edge and the content of the digital image, once the margin detection module 124 locates a distance, the module 124 may thereafter only seek shorter distances.

In other embodiments, the margin detection module 124 may skip one or more lines of pixels during the performance of the processing passes for the digital image 200. In various non-limiting examples, the margin detection module 124 may perform processing passes for every other line of pixels, every third line of pixels, etc. rather than performing processing passes for every line of pixels in the digital image 200. Such optimization may take advantage of the fact that the content of the digital image 200 generally spans more than one line of pixels in some instances.

It will be appreciated that the margin detection module 124 may determine the lengths of the right margin, the top margin, and the bottom margin, respectively, in a similar manner as for the length of the left margin described above with respect to FIG. 4. In other words, the margin detection module 124 may ascertain various distances between the respective right, top, and bottom edges of the digital image 200 and the content by detecting color changes in pixels between the background and the content during corresponding processing passes. The illustrative processing passes performed by the margin detection module 124 to obtain the lengths of the right, top, and bottom margins are further described in FIG. 5.

Figure 5:
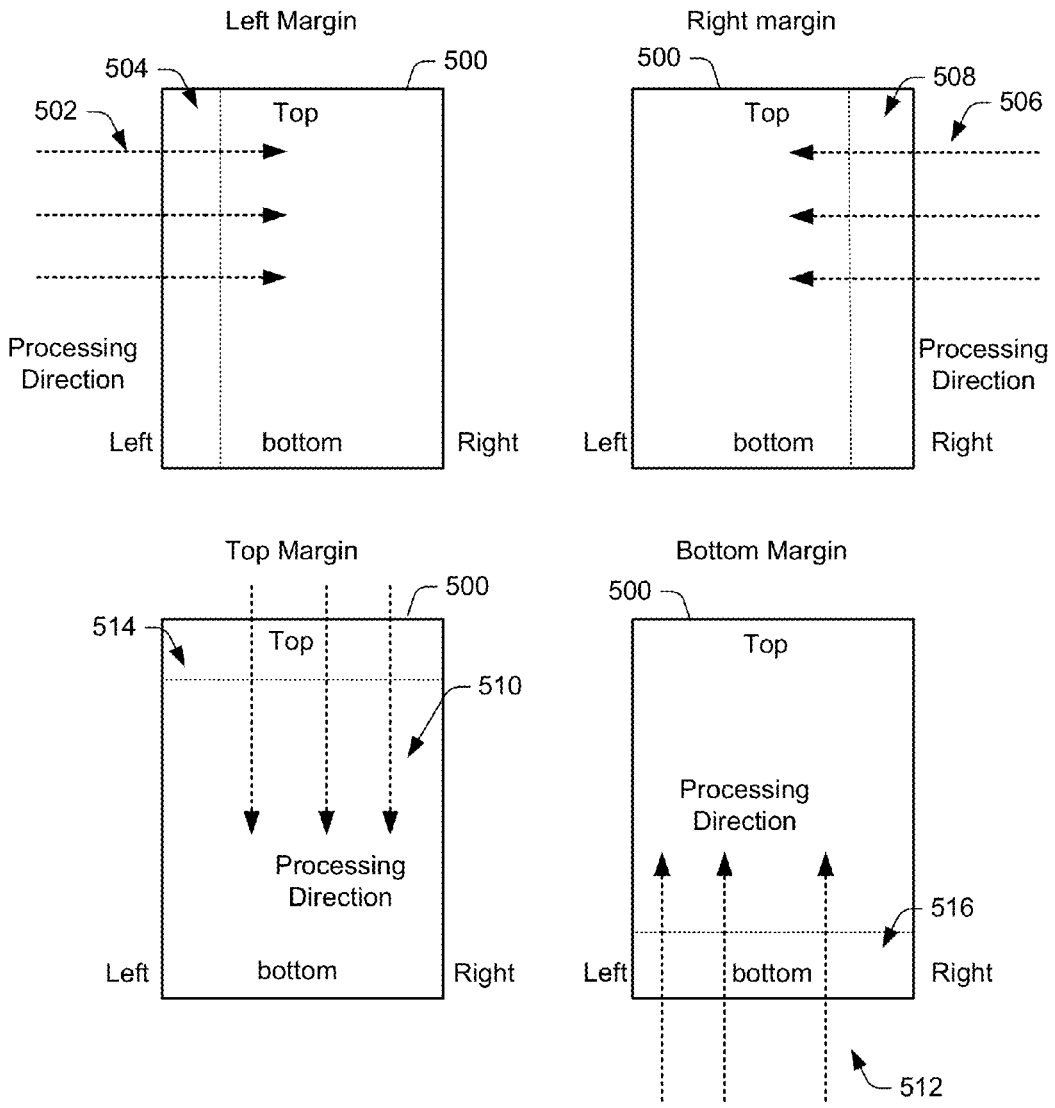
FIG. 5 shows the processing directions employed during the processing of the various margins of the digital image, in accordance with one or more embodiments.

FIG. 5 shows the illustrative processing directions employed during the processing for the various margins of the digital image 500, in accordance with one or more embodiments. As shown, the margin detection module 124 may employ left-to-right processing passes 502 to detect the left margin 504, consistent with the previous description in FIG. 4.

The margin detection module 124 may employ right-to-left processing passes 506 to detect a right margin 508 in a manner that is similar to detection of the left margin 502, as described in FIG. 4. In one or more embodiments, the margin detection module 124 may perform the processing passes 506 "line-by-line" while proceeding from the top of the digital image 500 to the bottom. In other embodiments, the margin detection module 124 may also perform the processing passes 502 and 506 "line-by-line" while proceeding from the bottom of the digital image 500 to the top.

Likewise, the margin detection module 124 may also employ top-to-bottom processing passes 506, and bottom-to-top processing passes 508 to detect a top margin 514 and the bottom margin 516, respectively. The margin detection module 124 may perform the top and bottom margin processing passes "line-by-line" either proceeding from the left of the digital image 500 to the right of the digital image 500, or proceeding from the right of the digital image 500 to the left of the digital image 500.

In various embodiments, the margin detection module 124 may conduct two types of the processing passes from the processing passes 502, 506, 510, and 512 iteratively. For example, but not as a limitation, the margin detection module 124 may perform a processing pass 502, then a processing pass 506, followed by another processing 502, and so on and so forth, as the margin detection module 124 moves back and forth down the digital image 500. In another non-limiting example, the margin detection module 124 may perform a processing pass 510, then a processing pass 512, followed by another processing pass 510, and so on an so forth, as the margin detection 124 moves back and forth across the digital image 500.

FIG. 6 shows illustrative elimination of artifacts from a digital image by the margin detection module 124 during the processing of the digital image, in accordance with one or more embodiments. For example, but not as a limitation, the digital image may be the digital image 200 of FIG. 2. As shown, the margin detection module 124 may attempt to ascertain the edge 604 of the left margin that borders the content. Accordingly, the margin detection module 124 may make repeated processing passes across the digital image from the left side to the right side of the digital image 200, in which the processing passes may start at the top of the digital image 200, and proceed vertically down the digital image 200. As further described above with respect to FIG. 4, the margin detection module 124 may determine that content is reached when a pixel has a color value that is different from the color value of the background of the digital image 200.

However, in accordance with some embodiments, the margin detection module 124 may perform a color validation check of pixels that have color values that are different from the color value of the background to ensure that the pixels truly represent content. In some embodiments, the margin detection module 124 may perform the validation of the non-background color pixel based on the similarity in color between the non-background color pixel and a predominate non-background color of the digital image. Thus, in such embodiments, the margin detection module 124 may have the ability to ascertain, based on the overall colors of the digital image 200, the most common non-background color present in the digital image 200, or the "dominate color value".

Returning to FIG. 6, the margin detection module 124 may make a processing pass 604(*a*) that reaches a pixel 606 that has a non-background color value, or "candidate color value". At such time, the margin detection module 124 may determine whether the candidate color value of the pixel 606 matches the dominate color value. If the candidate color value matches the dominate color value, then the margin detection module 124 may determine that the pixel 606 is part of the content. However, if the margin detection module 124 determines that the candidate color value of the pixel 606 does not match the dominate color value, the margin detection module 124 may determine that the pixel 606 is part of an artifact 608 and should be skipped. Accordingly, the processing pass 604 (*a*) may proceed to the next pixel and perform the same validation test.

Alternatively, in at least one other embodiment, the margin detection module 124 may accept a pixel as part of the content if its candidate color value is within a predetermined deviation range from the dominate color value. In at least one embodiment, the predetermined deviation range may be up to 10% hue deviation. Thus, if the candidate color value of a pixel, such as the pixel 606, is a grayscale color whose color value is within 10% hue deviation from the dominate color value, the margin detection module 124 may determine that the pixel 606 is part of the content that is on the digital image 200. Nevertheless, it will be appreciated that in other embodiments, the predetermined deviation range may be any range that serves to accommodate some natural variability with respect to the color of the content yet effectively distinguishes the content of the digital image 200 from artifacts, such as the artifact 608.

In alternative embodiments, the margin detection module 124 may perform a density check for each pixel that has a non-background color to ensure that each pixel is part of the content on the digital image 200. For example, as shown, the margin detection module 124 may make a processing pass 604(*b*) that reaches a pixel 610 that has a non-background color (as shown in magnified view 612). Having reached pixel 610, the margin detection module 124 may examine the color values of pixels 614 that fall within a predetermined proximity, such as within a radius "R" of the pixel 610. For example, the predetermined radius "R" may be two pixels in at least one embodiment. However, in other embodiments, any number of pixels may serve as the predetermined radius.

In such embodiments, the margin detection module 124 may determine that the pixel 610 is part of an artifact, such as an artifact 616, if the pixels 614 do not include a predetermined percentage/number of non-background color pixels having the same color as the pixel 610. For example, in at least one embodiment, the margin detection module 124 may determine the pixel 610 is part of an artifact 614 if the pixels 612 do not include at least 50% identically colored pixels. Nevertheless, the predetermined percentage/number of non-background color pixels (e.g., pixels 614) having the same color as the pixel being examined (e.g., pixel 610) may vary in other embodiments.

In further embodiments, the margin detection module 124 may only determine that a pixel is part of the content of the digital image 200 if the pixel passes both tests. In other words, the pixel is deemed to be part of the content if it (1) has a candidate color value that matches or is within a predetermined deviation of a dominate color value; and (2) is surrounded by a predetermined percentage/number of identically colored pixels.

Further, it will be appreciated that although the color validation and the density check tests for identifying pixels as either content or artifact are describe in FIG. 6 with respect to processing passes for a left margin, such color validation and density check tests may also be applied by the margin detection module 124 for other margins.

In addition to the color validation and the density check test described above, the margin detection module 124 may include other heuristics for eliminating artifacts. In at least one embodiment, after performing a predetermined number of left-to-right processing passes on the digital image 200, the margin detection module 124 may determine that a predetermined threshold percentage of the notations from the processing passes indicates that the distance between the content and the left edge 408 (FIG. 4) of the digital image 200 is a specific value. Accordingly, for the remaining left-to-right processing passes, the margin detection module 124 may determine that any pixel with a non-background color that is less than the specific value from the left edge 408 likely comprises an artifact. As an example, but not as a limitation, the predetermined threshold percentage may comprise 60%, 75,% 90%, 99% or any other percentage.

To illustrate, envision that the margin detection module has performed 100 passes and, for each of the passes, the margin detection module 124 has determined that the distance between the left edge 408 and the beginning of the content is a distance "X" (or is within a certain tolerance range of X). Next, envision that the margin detection module 124 then detects on a particular pass a non-background pixel at a distance of 0.5× from the left edge. Here, because the previous measured distances between the left edge 408 and the content comprised the distance "X" more than the threshold percentage (e.g., 90%), the margin detection module 124 may determine that the non-background pixel discovered at the distance of 0.5× comprises an artifact.

In some instances, the margin detection module 124 may wait to make this determination until after the processing of passes for most or the entire digital image. In addition, in some instances. That is, the margin detection module 124 may perform passes for the entire digital image before calculating a percentage of passes that measured a distance X between the left edge 408 and the content. At that point, the margin detection module 124 may then either determine that the non-background pixel at the distance 0.5× comprises an artifact or, conversely, that the non-background pixel comprises a portion of the content of the digital image.

In some embodiments, the margin detection module 124 may implement such additional heuristics for eliminating artifacts in combination with the color validation test and/or the density check test as described above. For example, the margin detection module 124 may initial left-to-right processing passes with the color validation test and/or the density check test until the predetermined number of processing passes is performed. At that point, the margin detection module 124 may switch to the artifact elimination heuristics described above. In other embodiments, the margin detection module 124 may use such heuristics in place of the color validation test and the density check test for various margins.

Returning to FIG. 1, the user interface module 126 may enable a user to interact with the various modules via user controls. The user controls may include, but are not limited to, combinations of one or more of keypads, keyboards, mouse devices, touch screens, microphones, speech recognition packages, and any other suitable devices or other electronic/software selection methods. Further, the user interface module 126 may also provide data to the user via the electronic display of an electronic device 104, such as the e-book reader 104(N).

The user interface module 126 may enable a user to control whether the digital image collections stored on the e-book reader 104(N) should be optimized, that is, whether the contents of the digital image collection should be expanded for display on the electronic display of the e-book reader 104(N). In various embodiments, the margin analysis module 116, the reformat module 120, and/or the image buffer module 122 may prompt users for confirmation via the user interface module before performing their respective operations. For example, but not as a limitation, the reformat module 120 may prompt a user prior to expanding a digital image, and/or provide the user with the option of reverting back to an original digital image 200 even after the expanded version of the digital image has been displayed. The reversion may be carried out by the reformat module 120 by retrieving the original digital image, such as the original digital image 200, from the data cache module 128. In further examples, the image buffer module 122 may prompt a user for confirmation prior to storing expanded digital images in the data cache module 128, uploading expanded digital images, and/or modifying the document 108 with the expanded digital image. Further, the user interface module 126 may have the ability to receive commands from the user that suspends the performance of operations by the margin analysis module 116, the reformat module 120 and/or the image buffer module 122. In accordance with some embodiments, the user interface module 126 may provide a menu that includes various menu options for interacting with the various modules.

The data cache module 128 may be configured to store data in a portion of the storage media 120 (e.g., a database) for the other modules, and provide the stored data to the modules upon demand. In various embodiments, the data cache module 128 may be configured to store digital image collections 108 that are to be presented, as well as data generated by the various modules. For example, but not as a limitation, the data cache module 128 may store the calculated margin lengths, the expansion factor, and one or more re-center values associated with each digital image. The data cache module 128 may also store candidate color values, dominate color values, as well as density data of the pixels that share identical color values for a plurality of digital images, such as the digital image 200. The data cache module 128 may also download and cache expanded digital images directly from the server 102 when directed by the user interface module 126. Further, the data cache module 120 may also cache modified digital image collections, as well as any additional data derived by the modules.

The server 102 may include one or more processors 130 and a storage media 132, which includes an operating system 134, as well as other modules. The modules may include routines, programs, objects, components, and data structures that cause the server 102 to perform particular tasks. The modules may include a margin data storage module 136, a data collection module 138, and a data distribution module 140.

The operating system 134 may perform various function that enables the server 102 to receive data via various inputs (e.g., user controls, network interfaces, memory devices), process the data using the one or more processors 110 to generate output, and present the output (e.g., display the data on an electronic display, store the data in memory, or transmit the data to another electronic device). Accordingly, the operating system 134 may include various program components for performing such tasks.

The data collection module 136 may receive the one or more expanded digital images, and/or expansion factor metadata, uploaded by the image buffer module 122 via the network 106. The received expanded digital images, such as the expanded digital image 200, may include metadata regarding the expansion (e.g., the size of the electronic displays for which the digital image collections were modified, manufacturer, model number, version number, device ID, serial number, etc. of the device that produced each expanded digital image).

The data storage module 138 may store the one or more expanded digital images, and/or expansion factor metadata, in a portion of the storage media 132 (e.g., a database). In some embodiments, the data storage module 138 may sort the one or more expanded digital images according to the metadata. For example, but not as a limitation, the data storage module 138 may sort the expanded digital images according to the size of the electronic displays for which the digital image collections were modified.

The data distribution module 140 may provide the one or more expanded digital images to one or more electronic devices 104 in lieu of the original digital image collections. For example, but not as a limitation, when a user commands an electronic device 104, such as the e-book reader 104(N), to display a specific digital image, the e-book reader 104(N) may use its operating system 114 to pass on the command for the requested digital image, as well as the display size of the electronic device, to the data distribution module 140 of the server 102. In response, the data distribution module 140 may provide an expanded digital image of the suitable size that corresponds to the original digital image to the e-book reader 104(N). The e-book reader 104(N) may the display the received expanded digital image on its electric display. In this, the need for the e-book reader 104(N) to perform digital image expansion via its various modules may be eliminated.

In additional embodiments, the server 102 may also include one or more of the modules (i.e., modules 116-128) described with respect to an electronic device 104, such as the e-book reader 104(N). In such embodiments, the server 102 may also perform the various expansion functions performed by the electronic device 104 on digital images, such as the digital image 200. Accordingly, the server 102 may apply an expansion factor to one or more digital images to create expanded digital images and send the one or more expanded digital images to at least one electronic devices 104. In at least some of these embodiments, at least one of the modules 116-128 may integrate with at least one module of the server 102. For example, but not as a limitation, the data storage module 138 may be integrated with the data cache module 128.

Illustrative Operations

FIG. 7 to FIG. 11 show illustrative processes 700-1100 for maximizing the display of electronic content of digital images on the electronic displays of electronic devices. Each of the processes 700-1100 is illustrated as a collection of blocks in a logical flow graph, which represents a sequence of operations that can be implemented in hardware, software, or a combination thereof. In the context of software, the blocks represent computer-executable instructions that, when executed by one or more processors, perform the recited operations. Generally, computer-executable instructions include routines, programs, objects, components, data structures, and the like that perform particular functions or implement particular abstract data types. The order in which the operations are described is not intended to be construed as a limitation, and any number of the described blocks can be combined in any order and/or in parallel to implement the process. For discussion purposes, the processes 700-1100 are described with reference to the environment 100 of FIG. 1.

Figure 7:
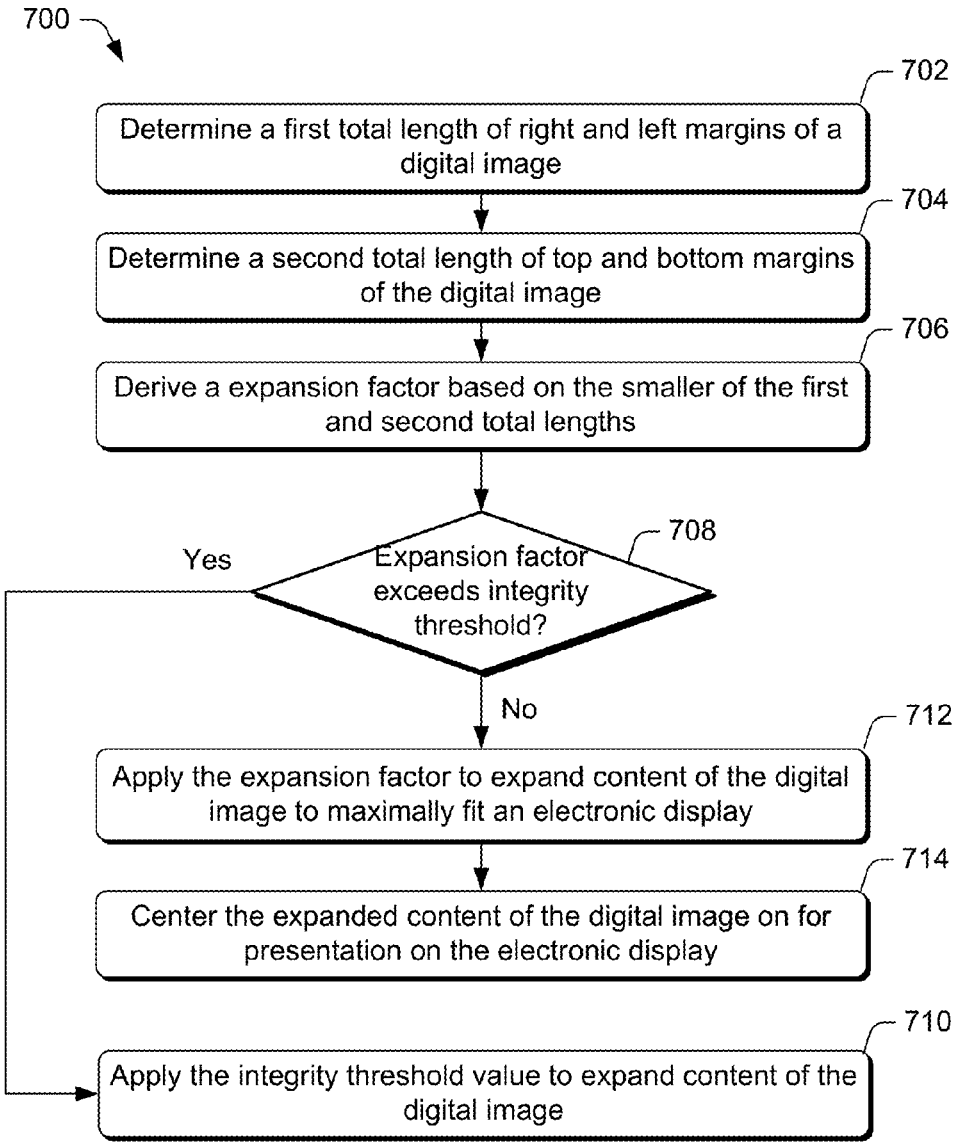
FIG. 7 is a flow diagram of an illustrative process of determining and applying an expansion factor to "crop" the margins of a digital image to produce an expanded digital image for display on an electronic display, in accordance with one or more embodiments.

FIG. 7 is a flow diagram of an illustrative process 700 for determining and applying an expansion factor to crop the margins that surround a digital image to produce an expanded digital image for display on an electronic display, in accordance with one or more embodiments. For example, but not as a limitation, the process 700 may be described with respect to the digital image 200.

At block 702, the margin analysis module 116 of an electronic device 104, such as the e-book reader 104(N), may determine a first total length of right and left margins of a digital image 200. In various embodiments, the margin analysis module 116 may use the margin detection module 124 to detect the left margin 202 and the right margin 204. The margin detection module 124 may distinguish content from artifacts (e.g., artifacts 608 and 616) during the detection of the respective left and right margins. In at least some embodiments, the margin analysis module 116 may initiate the determination when a user requests the presentation of the digital image 200 on the electronic display of the electronic device 104.

At block 704, the margin analysis module 116 may determine a second total length of the top and bottom margins of the digital image 200. In various embodiments, the margin analysis module 116 may use the margin detection module 124 to detect the top margin 206 and the bottom margin 208. The margin detection module 124 may distinguish content from artifacts during the detection of the respective top and bottom margins.

At block 706, the margin analysis module 116 may derive an expansion factor, such as the expansion factor $Z_f$, based on the smaller of the first and second total lengths. In at least one embodiment, the margin analysis module 116 may first derive a width of the content (e.g., the content 306) that is present in the digital image 200 by subtracting the first total length from the overall width of the digital image 200. Subsequently, the margin analysis module 116 may add the smaller of the first and second total lengths to the width of the content to obtain a sum, and may then divided the sum by the width of the content to obtain a ratio that is the expansion factor. The derivation of the expansion factor based on the smaller of the first total length and the second total length may ensure that the derived expansion factor does not cause one or more portions of the content to intrude outside of the electronic display of the electronic device 104 when the expansion factor is used to expand the digital image.

At decision block 708, the integrity checker 118 of the electronic device 104 may determine whether the expansion factor derived by the margin analysis module 116 exceeds a predetermined threshold. If the integrity checker 118 determines that the expansion factor exceeds a predetermined threshold, ("yes" at decision block 708), the integrity checker 118 may cause the reformat module 120 to apply the predetermined threshold, rather than the expansion factor, to expand the digital image 200 so that the content of the digital image is expanded when displayed on the electronic display (e.g., electronic display 302) of the electronic device 104. Such determination by the integrity checker 118 may protect against the blurring/pixilation of the digital image 200 due to application of the expansion factor. In other embodiments, the determination by the integrity checker 118 may protect again the creation of unmanageably large data files that may degrade the performance of the electronic device 104. However, in alternative embodiments, the integrity checker 118 may cause the process 700 to terminate at block 710 to protect the integrity of the digital image 200.

However, if the integrity checker 118 determines that the expansion factor does not exceed a predetermined threshold, ("no" at decision block 708), the process 700 may proceed to block 712.

At block 712, the reformat module 120 may use the expansion factor to expand the digital image 200 so that the display of the content on the electronic display (e.g., electronic display 302) of the electronic device 104 may be maximized. In other words, the reformat module 120 may use the expansion factor to crop the margins digital image 200 when the digital image 200 is displayed on the electronic display. Nevertheless, in additional embodiments, the reformat module 120 may modify the expansion factor into a modified expansion factor. The modified expansion factor may be a value that is a certain percentage less than the expansion factor. In such embodiments, the reformat module 120 may use the modified expansion factor to expand the digital image 200. Accordingly, when the digital image 200 is displayed on the electronic display, the content of the digital image 200 may be surrounded by reformatted margins that are smaller than the original margins of the digital image 200. In further embodiments, rather than simply expanding the digital image 200, the reformat module 120 may further modify the data that corresponds to the expanded digital image 200 by actually omitting a portion of the data that enables the display of the margins 202-208. In other words, the margins 202-208 of the expanded digital image 200 may be permanently deleted from the data of the expanded digital image 200.

At block 714, the reformat module 120 may also center the expanded content of the digital image 200 on the electronic display. In one or more embodiments, the expanded content may be centered at least one of horizontally or vertically.

Figure 8:
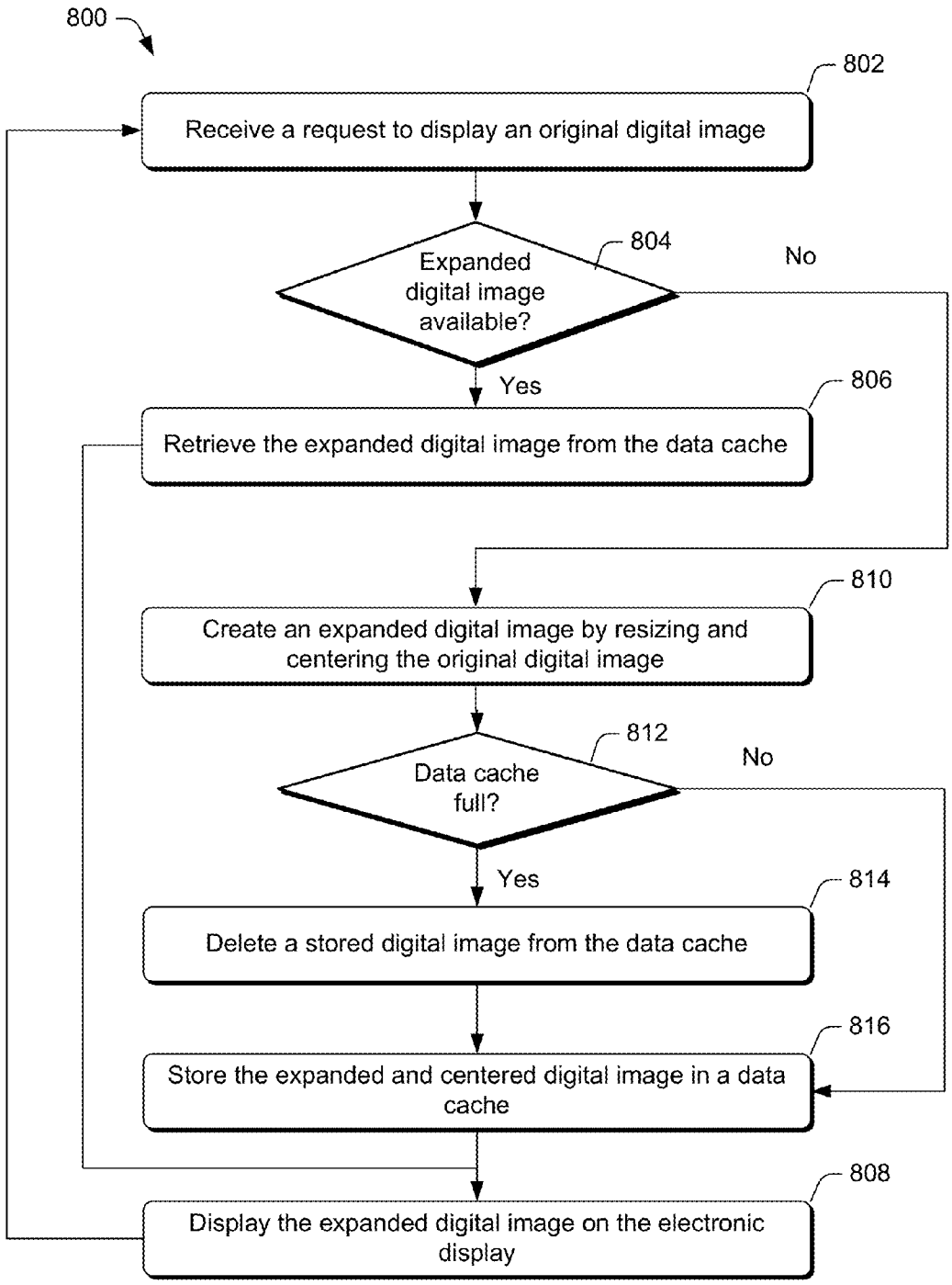
FIG. 8 is a flow diagram of an illustrative process for storing and retrieving expanded digital images for display on an electronic display, in accordance with one or more embodiments.

FIG. 8 is a flow diagram of an illustrative process 800 for storing and retrieving expanded digital images for display on an electronic display, in accordance with one or more embodiments.

At block 802, a user interface module 126 of an electronic device 104, such as the e-book reader 104(N), may receive a request to display a digital image, such as the digital image 200, on an electronic display (e.g., electronic display 302) of the electronic device 104. The request may be received from a user who input a command using the user controls on the electronic device 104. The use interface module 126 may pass the command to display the digital image to the margin analysis module 116.

At decision block 804, the margin analysis module 116 may use the image buffer module 122 to determine whether an expanded digital image is available in the electronic device 104. In accordance with at least one embodiment, the expanded digital image may be available in the data cache module 128 of the electronic device 104 if the expanded digital image had been cached after a previous viewing, or if an original digital image collection had been modified to include the expanded digital image after a previous viewing. In other embodiments, the digital image may be available if the electronic device 104 had downloaded the expanded digital image into the data cache module 128 from the server 102 as part of a digital image collection. In some embodiments, the expanded digital image may be an expanded digital image whose margins are deleted following expansion.

Thus, if the image buffer module 122 determines that the expanded digital image is available on the electronic device 104 ("yes" at decision block 804), the process 800 may proceed to block 806. At block 806, the margin analysis module 116 may cause the data cache module 128 to retrieve the expanded digital image from the data cache. At block 808, the data cache module 116 may present the retrieved digital image on the electronic display of the electronic device 104

However, if the image buffer module 122 determines that the expanded digital image is not available on the electronic device 104 ("no" at decision block 806), the process may proceed to block 810.

At block 810, the electronic device 104 may create an expanded digital image via the margin analysis module 118 and the reformat module 120 as described in FIG. 7. As described above, the margin analysis module 118 may determine an expansion factor to maximize the display of the content, and the reformat module 120 may apply the expansion factor to expand the digital image and center the digital image.

At decision block 812, the image buffer module 122 may determine whether the data cache of the electronic device 104 is full. In various embodiments, the data cache of the electronic device 104 may be configured to store a predetermined number of expanded digital images (e.g., ten digital images). If the image buffer module 122 determines that the data cache is full ("yes" at decision block 812), the process 800 may proceed to block 814. The data cache may be included in the data cache module 128.

At block 814, the image buffer module 122 may delete a stored digital image from the data cache to make room for the expanded digital image to be stored. In various embodiments, the image buffer module 122 may delete a stored digital image on a first in, first out (FIFO) basis. At block 816, the image buffer module 122 may store the expanded and centered digital image in the data cache for subsequent retrieval.

However, returning to decision block 812, if the image buffer module 122 determines that the data cache is not full ("no" at decision block 812), the process 800 may proceed to block 816 so that the expanded and centered digital image may be stored directly in the data cache.

Following storage at block 816, the process 800 may again proceed to block 808, at which point the reformat module 120 may present the expanded digital image on the electronic display of the electronic device 104.

Figure 9:
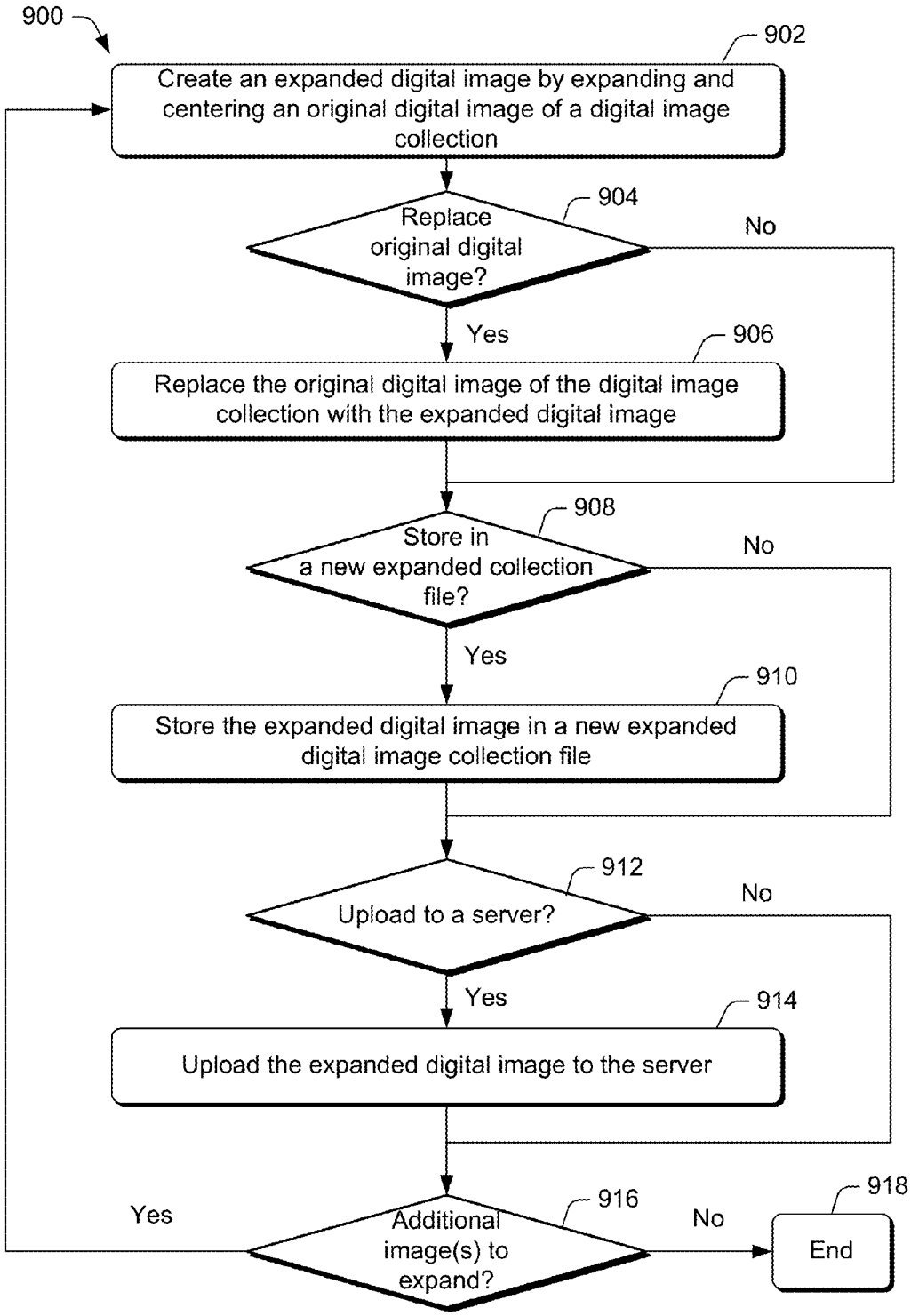
FIG. 9 is a flow diagram of an illustrative process for modifying or creating expanded digital image collections using one or more expanded digital images, in accordance with one or more embodiments.

FIG. 9 is a flow diagram of an illustrative process 900 for modifying and creating expanded digital image collections using one or more expanded digital images, in accordance with one or more embodiments. It will be appreciated that process 900 may be implemented stand alone or in overlap with the process 800 described in FIG. 8. For example, but not as a limitation, the process 900 may be described with respect to the digital image 200.

At block 902, the electronic device 104 may create an expanded digital image from an original digital image 200 via the margin analysis module 118 and the reformat module 120 as described in FIG. 7. As described above, the margin analysis module 118 may determine an expansion factor to maximize the display of the content, and the reformat module 120 may apply the expansion factor to expand the digital image and center the digital image. Furthermore, in some embodiments, the expanded digital image may be an expanded digital image whose margins are deleted following expansion. The original digital image 200 may be part of an original digital image collection (e.g., the digital image collection 108).

At decision block 904, the image buffer module 122 may determine whether the expanded digital image 200 is to replace the corresponding original digital image in the original digital image collection. In some embodiments, the image buffer module 122 may make the determination based on the configuration settings supplied by a user via the user interface module 126. In other embodiments, the image buffer module 122 may make the determination based on a user's response to a prompt provided by the image buffer module 122 via the user interface module 126.

If the image buffer module 122 determines that the corresponding original digital image is to be replaced ("yes" at decision block 904), the process 900 may proceed to block 906. At block 906, the image buffer module 122 may replace the original digital image 200 of the original digital image collection with the corresponding expanded digital image. Subsequently, the process 900 may proceed to block 908.

However, if the image buffer module 122 determines that the corresponding original digital image is not to be replaced ("no" at decision block 904), the process 900 may proceed directly to decision block 908.

At decision block 908, the image buffer module 122 may determine whether the expanded digital image 200 should be stored in a new expanded digital image collection file. In some embodiments, the image buffer module 122 may make the determination based on the configuration settings supplied by a user via the user interface module 126. In other embodiments, the image buffer module 122 may make the determination based on a user's response to a prompt provided by the image buffer module 122 via the user interface module 126.

If the image buffer module 122 determines that the expanded digital image 200 should be stored in the new expanded digital image collection file ("yes" at decision block 908), the process 900 may proceed to block 910. At block 910, the image buffer module 122 may store the expanded digital image 200 in the new expanded digital image collection file. In accordance with various embodiments, the storage of the expanded digital image 200 in the new expanded digital image collection file may involve creating the new expanded digital image collection file prior to storage. In alternative embodiments, the storage of the expanded digital image 200 may be performed by appending the expanded digital image 200 into an existing expanded digital image collection file that includes another expanded digital image for the same original digital image collection. Subsequently, the process 900 may proceed to decision block 912.

However, if the image buffer module 122 determines that expanded digital image 200 is not to be stored ("no" at decision block 904), the process 900 may proceed to directly decision block 912.

At decision block 912, the image buffer module 122 may determine whether the expanded digital image 200 is to be uploaded to a server, such as the server 102. In some embodiments, the image buffer module 122 may make the determination based on the configuration settings supplied by a user via the user interface module 126. In other embodiments, the image buffer module 122 may make the determination based on a user's response to a prompt provided by the image buffer module 122 via the user interface module 126.

If the image buffer module 122 determines that the expanded digital image 200 is to be uploaded, ("yes" at decision block 912), the process 900 may proceed to block 914. At block 914, the image buffer module 122 may upload the expanded digital image 200 to the server. Subsequently, the process 900 may proceed to decision block 916.

However, if the image buffer module 122 determines that the expanded digital image 200 is not to be uploaded ("no" at decision block 912), the process 900 may proceed directly to decision block 916.

At block 916, the electronic device 104 may wait for additional digital images to expand. In various embodiments, the user interface 126 may wait for the user to request another digital image for viewing. If the electronic device 104 determines via the user interface module 126 that the user has requested another digital image for viewing ("yes" at decision block 916), the process may loop back to decision block 902, where the process 900 is repeated for another digital image. However, if the electronic device 104 determines that there are no more digital images to expand ("no" at decision block 916), such as in instances in which the end of the digital image collection is reached or the user powering off the electronic device 104, the process 900 may terminate at block 918.

It will be appreciated that with respect to the decisions blocks 908 and 912, the image buffer module 122 may alternatively determine whether an expansion factor corresponding to the expanded digital image 200 should be respectively stored in the data cache module 128 and uploaded to the server 102. Thus, at blocks 910 and 914, the image buffer module 122 may store an expansion factor and/or upload the expansion factor to the server 102, respectively, depending the outcomes at decision blocks 908 and 912.

Figure 10:
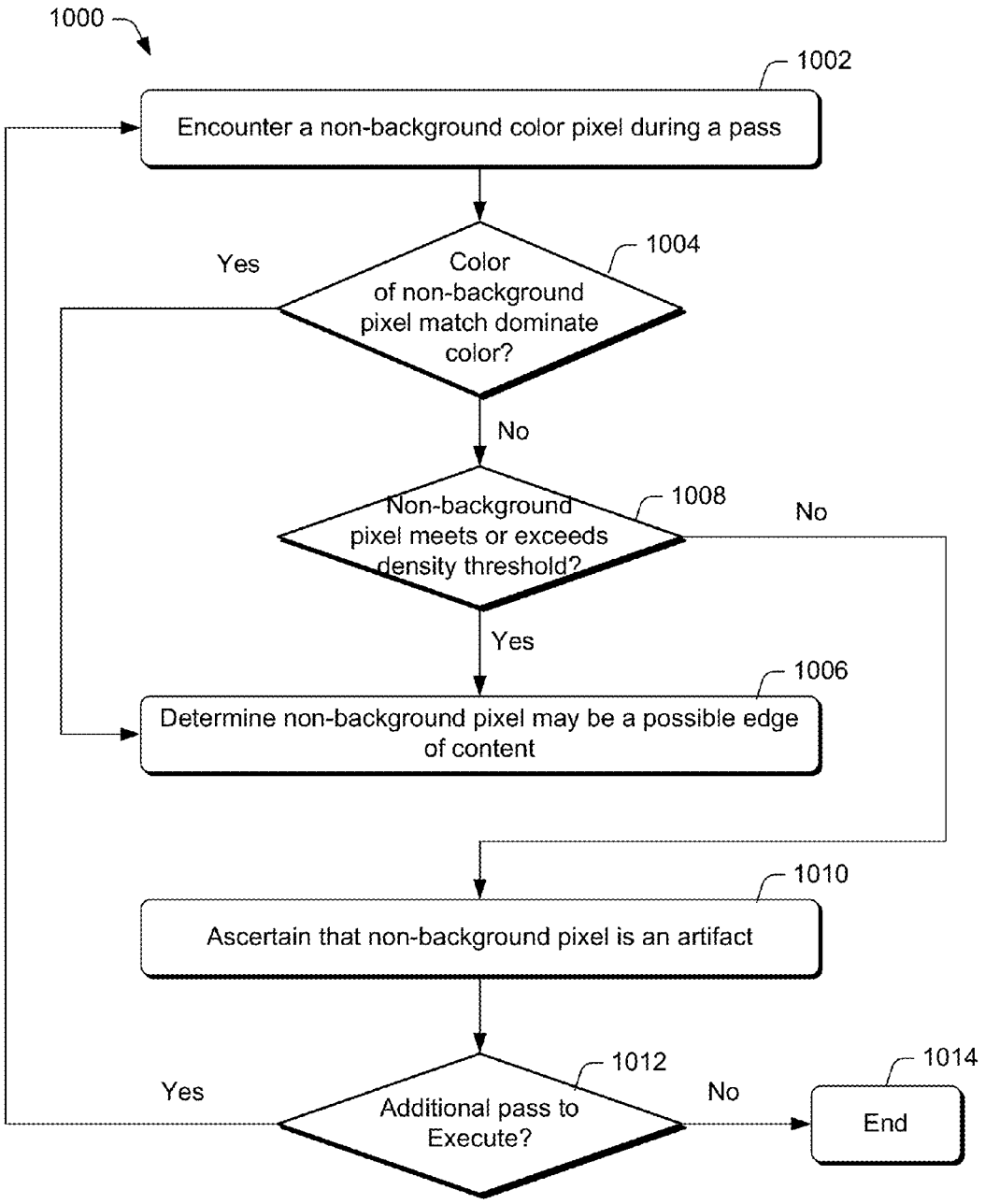
FIG. 10 is a flow diagram of an illustrative process for eliminating artifacts from a digital image during the processing of the document image to determine a length of a margin on the digital image, in accordance with one or more embodiments.

FIG. 10 is a flow diagram of an illustrative process 1000 for eliminating artifacts from a digital image during the processing of a digital image to determine a length of a margin on the digital image, in accordance with one or more embodiments. For example, but not as a limitation, the process 1000 may be described with respect to the digital image 200.

At block 1002, the margin detection module 124 of an electronic device 104, such as the e-book reader 104(N), may encounter a non-background color pixel during a processing pass. At decision block 1004, the margin detection module 124 may determine whether the color of non-background pixel (i.e., candidate color) matches or is within a predetermined deviation range of the dominate color of the digital image. If the margin detection module 124 determines that the color of the non-background pixel matches or is within a deviation range ("yes" at decision block 1004), the process 1000 may proceed to block 1006. At block 1006, the margin detection module 124 may determine that the non-background pixel may be a possible edge of the content in the digital image.

However, if the margin detection module 124 determine determines that the color of the non-background pixel (e.g., pixel 606), does not match or is not within a deviation range ("no" at decision block 1004), the process 1000 may proceed to block 1008.

At block 1008, the margin detection module 124 may determine whether the non-background pixel (e.g., pixel 610) meets or exceeds a density threshold. In other words, the margin detection module 124 may determine whether there are sufficient numbers of non-background pixels within a predetermined proximity (e.g., radius) of the non-background pixel. If the margin detection module 124 determines that the non-background pixel meets or exceeds the density threshold ("yes" at block 1008), the process 1000 may proceed to block 1006. At block 1006, the margin detection module 124 may determine that the non-background pixel may be a possible edge of the content in the digital image.

However, if the margin detection module 124 determines that the background pixel does not meet the density threshold ("no" at block 1008), the process 1000 may proceed to block 1010. At block 1010, the margin detection module 124 may determine that the non-background pixel is an artifact.

At decision block 1012, the margin detection module 124 may determine whether there is an additional processing pass to execute. In various embodiments, the margin detection module 124 may determine that there is an additional processing pass to execute if a particular margin (e.g., left margin, right margin, top margin, or bottom margin) of the digital image has not yet been completely scanned. If the margin detection module 124 determines that there is an additional processing pass to execute ("yes" at decision block 1012), the process 1000 may loop back to block 1002. However, if the margin detection module 124 determines that there are no additional processing passes to execute ("no" at decision block 1012), the process 1000 may terminate at block 1014.

Figure 11:
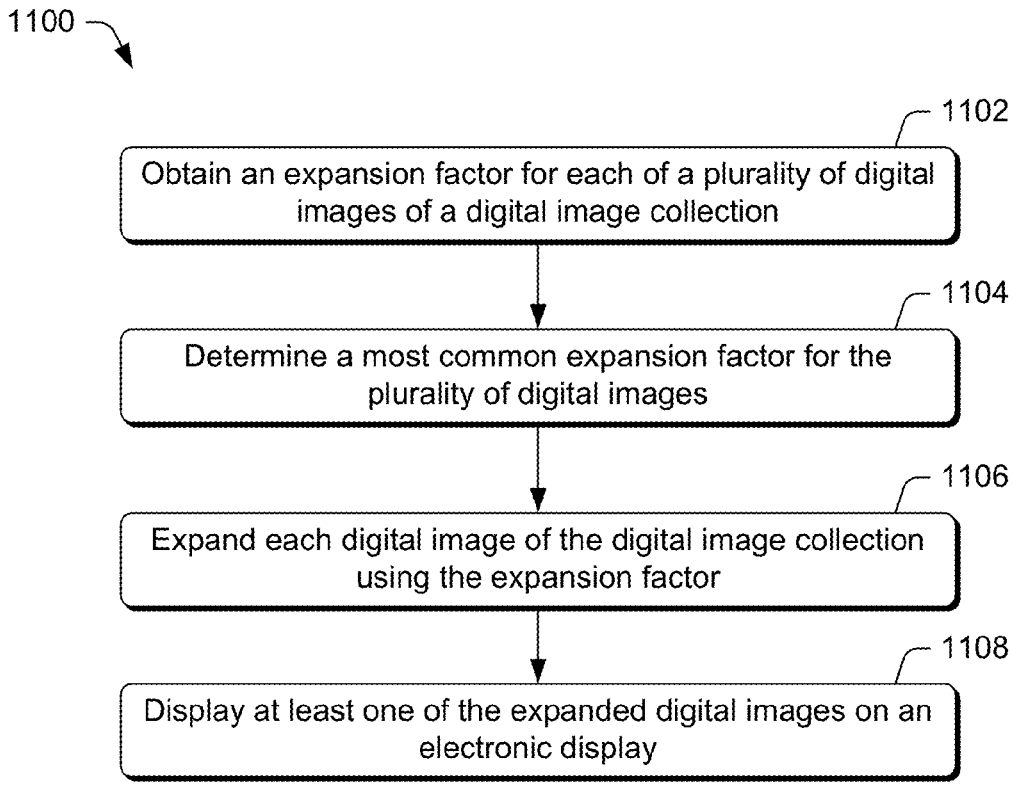
FIG. 11 is a flow diagram of an illustrative process for applying a common expansion factor from a plurality of digital images to "crop" the margins of other digital images in a collection of digital images, in accordance with various embodiments.

FIG. 11 is a flow diagram of an illustrative process 1100 for applying a most common expansion factor from a plurality of digital images to crop the margins of the digital images in a digital image collection, in accordance with various embodiments.

At block 1102, the margin analysis module 116 of an electronic device 104, such as the e-book reader 104(N), may obtain an expansion factor for each of a plurality of digital images of a digital image collection. In various embodiments, the margin analysis module 116 may obtain the plurality of expansion factors for consecutive digital images from anywhere in the digital image collection (e.g., beginning of digital image collection, middle of digital image collection, end of digital image collection). In other embodiments, the margin analysis module 116 may obtain the plurality of expansion factors for random digital images from the digital image collection.

At block 1104, the margin analysis 116 may determine a common (e.g., a most common) expansion factor that is obtained for the plurality of digital images. For example, but not as a limitation, if the set of expansion factors is {1.2, 1.2, 1.2 1.8, 1.1}, the margin analysis module 116 may determine that the median expansion factor of "1.2", the mean expansion factor of "1.3", or the smallest expansion factor of "1.1" is the most common expansion factor. The margin analysis module 116 may then designate the most common expansion factor as the universal expansion factor to be applied to every digital image in the digital image collection.

At block 1106, the reformat module 120 may expand each digital image of the digital image collection using the expansion factor. In at least one embodiment, the reformat module 120 may perform the expansion for the plurality of digital images in the background when the processors of the electronic device 104 would be otherwise idle. In some embodiments, rather than simply expanding the digital images, the reformat module 120 may further modify the data that corresponds to each expanded digital image by actually omitting a portion of the data that enables the display of the margins. In other words, the margins of each expanded digital image 200 may be permanently deleted from the data of the expanded digital image.

At block 1108, the reformat module 120 may display at least one of the expanded digital images on an electronic display of the electronic device 104. In various embodiments, the reformat module 120 may display the at least one of the expanded digital images upon a user request received via the user interface module 126.

CONCLUSION

Although the subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims.

What is claimed is:

1. A computer implemented method, comprising:

under control of one or more computing systems configured with executable instructions, determining a first total length of a left margin and a right margin of a digital image for presentation on an electronic book (e-book) reader device;

determining a second total length of a top margin and a bottom margin of the digital image;

deriving an expansion factor based at least in part on a smaller length of the first and second total lengths; and applying the expansion factor to the digital image to create an expanded digital image having content that maximally fits the e-book reader device to effectively crop the margins from display on the e-book reader device.

2. The computer implemented method of claim 1, further comprising:

centering the expanded digital image for presentation on the e-book reader device; and displaying the expanded digital image on the e-book reader device.

3. The computer implemented method of claim 1, wherein the applying of the expansion factor comprises:

comparing the expansion factor to an integrity threshold;

applying the expansion factor when the expansion factor is less than or equal to an integrity threshold; and applying the integrity threshold as the expansion factor when the expansion factor exceeds the integrity threshold.

4. The computer implemented method of claim 1, wherein the deriving of the expansion factor comprises:

adding a smaller length of the first and second total lengths to a width of the content in the digital image to obtain a total value; and dividing the total value by the width of the content in the digital image to derive the expansion factor.

5. The computer implemented method of claim 1, further comprising:

performing processing passes to detect a corresponding non-background pixel that is closest to each of a left edge, a right edge, a top edge, and a bottom edge of the digital image, the non-background pixel being part of the content in the digital image; and determining a corresponding length for each of a right margin, a left margin, a top margin, or a bottom margin that corresponds to the left edge, the right edge, the top edge, and the bottom edge, respectively, each corresponding length being determined based at least in part on a distance between each edge of the digital image and the closest corresponding non-background pixel, wherein the determining of the first total length includes adding the lengths of the left and right margins, and the determining of the second total length includes adding the lengths of the top and bottom margins.

6. A non-transitory computer readable medium storing computer-executable instructions that, when executed, cause one or more processors to perform acts comprising:

receiving a request to display a digital image on an electronic display;

deriving an expansion factor for the digital image based at least in part on a smaller length of a first length or a second length, the first length including lengths of a left margin and a right margin of the digital image, and the second length including lengths of a top margin and a bottom margin of the digital image;

applying the expansion factor to the digital image to create an expanded digital image;

centering the expanded digital image for presentation on the electronic display; and displaying the expanded digital image on the electronic display so that at least a portion of the margins are cropped from display on the electronic display.

7. The non-transitory computer readable medium of claim 6, wherein the deriving includes:

adding the smaller length of the first and second lengths to a width of content in the digital image to obtain a total value; and dividing the total value by the width of the content in the digital image to derive the expansion factor.

8. The non-transitory computer readable medium of claim 6, further comprising instructions that when executed, cause one or more processors to perform acts of:

performing processing passes to detect a corresponding non-background pixel that is closest to each of a left edge, a right edge, a top edge, and a bottom edge of the digital image, the non-background pixel being part of content in the digital image; and determining a corresponding length for each of a right margin, a left margin, a top margin, or a bottom margin that corresponds to the left edge, the right edge, the top edge, and the bottom edge, respectively, each corresponding length being determined based at least in part on a distance between each edge of the digital image and a closest corresponding non-background pixel.

9. The non-transitory computer readable medium of claim 8, wherein the performing processing passes to detect a corresponding non-background pixel includes eliminating artifacts via performing at least one of a color validation check or a density check.

10. The non-transitory computer readable medium of claim 9, wherein the eliminating of the artifact comprises performing the color validation check, and wherein the performing of the color validation check comprises determining that the non-background pixel is part of the content when a color of the non-background pixel matches or is within a predetermined deviation range of a dominate color of the digital image.

11. The non-transitory computer readable medium of claim 9, wherein the eliminating of the artifact comprises performing the density check, and wherein the performing of the density check comprises determining that the non-background pixel is part of the content when a quantity of additional non-background pixels within a predetermined distance of the non-background pixel meets or exceeds a predetermined threshold.

12. A device comprising:

a processor; and memory storing modules executable by the processor, the modules comprising:

a margin analysis module that derives an expansion factor for an original digital image based at least in part on a smaller length of a first length or a second length, the first length including combined lengths of a left margin and a right margin of the original digital image, and the second length including combined lengths of a top margin and a bottom margin of the original digital image; and a reformat module that applies the expansion factor to the original digital image to create an expanded digital image that, when rendered on a display of an electronic device, comprises a reformatted margin having a size that is smaller than the size of the margin of the original digital image.

13. The device of claim 12, wherein the margin analysis module derives the expansion factor in response to determining that the expansion factor for the original digital image is unavailable from a data cache.

14. The device of claim 12, wherein the reformat module further applies the expansion factor to the original digital image to create an expanded digital image having content that maximally fits an electronic device.

15. The device of claim 12, wherein the reformat module further centers the expanded digital image for presentation on an electronic device.

16. The device of claim 12, wherein the margin analysis module further checks whether the expanded digital image is available for download from a server prior to deriving the expansion factor for the original digital image.

17. The device of claim 12, wherein the margin analysis module derives the expansion factor by:

obtaining a first length that includes combined lengths of a left margin and a right margin of the digital image, and a second length that includes combined lengths of a top margin and a bottom margin of the digital image;

adding a smaller length of the first and second lengths to a width of content in the digital image to obtain a total value; and dividing the total value by the width of the content in the digital image to derive the expansion factor.

18. The device of claim 12, wherein the modules further comprise an image buffer module that uploads the expanded digital image to a server.

19. The device of claim 12, wherein the digital image comprises a portion of a digital image collection, and wherein the modules further comprise an image buffer module that deletes the original digital image from the digital image collection and append the expanded digital image to the digital image collection in place of the original digital image.

20. The device of claim 12, wherein the modules further comprise an image buffer module that creates a data file in the memory to store the expanded digital image or append the expanded digital image to an existing data file in the memory.

21. The device of claim 12, wherein the modules further comprise:

a user interface module that receives a request to display the original digital image on an electronic device; and a display module that displays the expanded digital image on the electronic device.

22. The device of claim 12, wherein the modules further comprise a data distribution module that serves the expanded digital image to an electronic device for rendering on a display of the electronic device.

23. The device of claim 12, wherein the modules further comprise an image buffer module to delete one of a plurality of previously stored digital images from the data cache in response to determining that the data cache is full and to further store the expanded digital image in the data cache.

24. A non-transitory computer readable medium storing computer-executable instructions that, when executed, cause one or more processors to perform acts comprising:

deriving an expansion factor for an original digital image based at least in part on a smaller length of a first total length and a second total length, the first total length includes combined lengths of a left margin and a right margin of the original digital image, and the second total length includes combined lengths of a top margin and a bottom margin of the original digital image, the expansion factor for applying to the original digital image to create an expanded digital image that, when rendered on a display of an electronic device, comprises a reformatted margin having a size that is smaller than at least one margin of the original digital; and storing the expansion factor in association with the original digital image in memory of a computing device.

25. The non-transitory computer readable medium of claim 24, further comprising instructions that, when executed, cause the one or more processors to perform acts comprising:

receiving a request for the original digital image or the expanded digital image from an electronic device; and serving the original digital image and the expansion factor to the electronic device in response to the receiving of the request, the expansion factor for applying to the original digital image by the electronic device to create the expanded digital image.

26. The non-transitory computer readable medium of claim 24, further comprising instructions that, when executed, cause the one or more processors to perform acts comprising:

receiving a request for the original digital image or the expanded digital image from an electronic device;

applying the expansion factor to the original digital image to create the expanded digital image; and serving the expanded digital image to the electronic device in response to the receiving of the request.

27. The non-transitory computer readable medium of claim 24, wherein the deriving includes:

adding the smaller length of the first and second total lengths to a width of content in the original digital image to obtain a total value; and dividing the total value by the width of the content in the digital image to derive the expansion factor.

28. A computer implemented method, comprising:

under control of one or more computing systems configured with executable instructions, receiving expansion factors associated with at least some original digital images of a plurality of original digital images of a digital image collection;

determining at least one of a median or a mean expansion factor for the plurality of original digital images of the digital image collection based at least in part on the expansion factors;

expanding at least one original digital image of the digital image collection using the determined median or mean expansion factor to create at least one expanded digital image;

determining that a data cache is full; and deleting one or more of a plurality of previously stored original digital images from the data cache prior to storing the at least one expanded digital image in the data cache.

29. The computer implemented method of claim 28, further comprising displaying or serving for display the at least one expanded digital image.

30. The computer implemented method of claim 28, wherein the determining includes determining the median or the mean expansion factor for the plurality of original digital images that appear consecutively or randomly within the digital image collection.

31. The computer implemented method of claim 28, wherein the receiving includes deriving at least one of the expansion factors for an original digital image based at least in part on a smaller length of a first total length and a second total length, the first total length includes combined lengths of a left margin and a right margin of the original digital image, and the second total length includes combined lengths of a top margin and a bottom margin of the original digital image.

32. The computer implemented method of claim 28, further comprising centering the at least one expanded digital image for presentation on an electronic display.

* * * * *